US008962961B2

(12) United States Patent
Masuda et al.

(10) Patent No.: US 8,962,961 B2
(45) Date of Patent: Feb. 24, 2015

(54) MUTE FOR BRASS INSTRUMENT

(75) Inventors: Hideyuki Masuda, Hamamatsu (JP); Yuichiro Suenaga, Hamamatsu (JP)

(73) Assignee: Yamaha Corporation (JP)

( * ) Notice: Subject to any disclaimer, the term of this patent is extended or adjusted under 35 U.S.C. 154(b) by 261 days.

(21) Appl. No.: 13/569,370

(22) Filed: Aug. 8, 2012

(65) Prior Publication Data

US 2013/0036895 A1 Feb. 14, 2013

(30) Foreign Application Priority Data

Aug. 10, 2011 (JP) ..... 2011-175059

(51) Int. Cl.
*G10D 9/06* (2006.01)

(52) U.S. Cl.
CPC ..... *G10D 9/06* (2013.01)
USPC ..... 84/400

(58) Field of Classification Search
USPC ..... 84/387 R, 400, 387 A
See application file for complete search history.

(56) References Cited

U.S. PATENT DOCUMENTS

| | | | | |
|---|---|---|---|---|
| 2,621,553 | A | | 12/1952 | Daoust |
| 4,178,829 | A | | 12/1979 | Wolford |
| 4,998,959 | A | | 3/1991 | Purdie |
| 5,309,808 | A | | 5/1994 | Tarrant |
| 5,373,771 | A | | 12/1994 | Weik et al. |
| 5,438,156 | A | | 8/1995 | Masuda et al. |
| 5,488,893 | A | | 2/1996 | Lewis et al. |
| 5,569,864 | A | | 10/1996 | Hamanaga et al. |
| 5,973,246 | A | * | 10/1999 | Hamanaga et al. ..... 84/400 |
| 6,114,619 | A | | 9/2000 | Thompson |
| 7,049,501 | B2 | | 5/2006 | Shellhammer et al. |
| 2004/0261602 | A1 | | 12/2004 | Shellhammer et al. |

FOREIGN PATENT DOCUMENTS

| | | | |
|---|---|---|---|
| CN | 2308138 | Y | 2/1999 |
| DE | 296 08 348 | U1 | 9/1996 |
| EP | 2 360 676 | A1 | 8/2011 |
| FR | 2 725 297 | A1 | 4/1996 |
| GB | 232050 | | 4/1925 |
| GB | 2 017 999 | A | 10/1979 |
| JP | 5-143079 | A | 6/1993 |
| JP | 2707913 | B2 | 2/1998 |
| JP | 2004-240347 | A | 8/2004 |
| JP | 4986091 | B1 | 5/2012 |

OTHER PUBLICATIONS

Extended European Search Report for corresponding EP 12005760.9, mail date Apr. 15, 2014.
Chinese Office Action for corresponding CN201210279994.6, mail date Feb. 21, 2014. English translation provided.

* cited by examiner

*Primary Examiner* — Kimberly Lockett
(74) *Attorney, Agent, or Firm* — Rossi, Kimms, McDowell LLP

(57) ABSTRACT

A mute detachably attached to a brass instrument includes a fixed part and a plurality of branch pipes, each including a main pipe and an auxiliary pipe. The branch pipes are unified together and inserted into a bell pipe of a brass instrument. The fixed part is attached to the tapered portion of a bell pipe and interposed between the interior of the bell pipe and the exterior of the main pipe. The branch pipe is designed such that the auxiliary pipe is connected to the main pipe at an interconnect part, at which an air flow propagating through the main pipe is partly branched into the auxiliary pipe.

7 Claims, 20 Drawing Sheets

MUTE FOR BRASS INSTRUMENT

BACKGROUND OF THE INVENTION

1. Field of the Invention

The present invention relates to a mute for a wind instrument such as a brass instrument, in particular to a mute adapted to a horn-shaped sounder of a brass instrument such as a bell of a trumpet.

The present application claims priority on Japanese Patent Application No. 2011-175059, the content of which is incorporated herein by reference.

2. Description of the Related Art

Conventionally, various technologies for synthesizing musical tones simulating tone-generation mechanisms of acoustic musical instruments have been developed and disclosed in various documents. PLT 1 discloses a musical tone synthesizing apparatus simulating a tone-generation mechanism of a wind instrument including a mouthpiece and a resonating pipe with an excitation part a junction, and waveguides. PLT 2 discloses a wind type tone synthesizer including the same technology as PLT 1 relating to a taper theorem simulating resonating property of a wind instrument with a branch pipe using straight pipes. Specifically; PLT 1 and PLT 2 disclose the technology for approximately reproducing resonating property of a tapered pipe having a conical surface with two types of straight pipes.

FIG. 19 shows the structure of a wind instrument 1000A with a tapered pipe 450. FIG. 20 shows the structure of a wind instrument 1000B with straight pipes 410, 420 simulating resonating property of the tapered pipe 450 shown in FIG. 19. Specifically, the wind instrument 1000A includes a mouthpiece 500A and a pipe structure 400A with the tapered pipe 400A. The wind instrument 1000B includes a mouthpiece 500B and a pipe structure 400B branching into the straight pipes 410, 420. Herein, the pipe structure 400B is able to approximately reproduce resonating property of the tapered pipe 450 when the straight pipes 410, 420 are designed with optimum lengths and diameters as disclosed in PLT 1.

Additionally, various mating technologies applied to wind instruments or brass instruments have been developed and disclosed in various documents. PLT 3 discloses a ring mute which, is made of sound absorbent material and attached onto the rim of the bell of a brass instrument instead of inside the bell of the brass instrument. PLT 4 discloses a mute, having a resonating dish with an opening and a slit, which is attached to the outside of the bell of a horn-type instrument by use of adjustable fitting means. PLT 5 discloses an acoustic practice mute for a brass instrument. PLT 6 discloses a sound reflector device which reflects sound rearwardly from the belt of a brass instrument towards the ears of a player. PLT 7 discloses a conical-shaped mute including a plurality of ribs and a plurality of plugs. PLT 8 and PLT 9 disclose a mute adapted to a brass instrument with an inner surface which is shaped in consideration of nodes of standing waves of harmonic tones. PLT 10 discloses a ventilated mute with an electrically-driven ventilation system which is attached to the bell of a wind instrument. PLT 11 discloses a ring mute, comprised of a sound absorbent foam urethane ring, which is attached to the rim of the bell of a brass instrument PLT 12 discloses a mate for a brass instrument which includes a breath induction pipe and a breath exhaust pipe so as to improve blowing property of a brass instrument with muted sound.

To reduce sound volume, a player needs to play a wind instrument or a brass instrument equipped with a mute which is inserted into a bell pipe. When a player plays a brass instrument equipped with a conventionally-known mute, it is possible to reduce sound volume owing to the mute, however, which may significantly change the resonating property of a brass instrument so as to unexpectedly change pitches and sound quality.

Generally speaking, pitches and sound quality of brass instruments highly depend on resonating property of brass instruments. Compared to resonating property of a brass instrument not equipped with a mute, resonating property of a brass instrument equipped with a mute may inevitably include additional resonating peaks in the low register, which in turn pushes original resonating peaks in the low register towards the high register, thus increasing resonating frequencies. That is, a mute attached to a brass instrument may increase pitches in the low register. Although, conventionally-known mutes are able to reduce sound volume, they may unexpectedly change pitches and sound quality compared with original pitches and sound quality produced with wind instruments not equipped with mutes. PLT 3 to PLT 11 disclose solutions to prevent unwanted changes of pitches and sound quality due to mutes attached to wind instruments or brass instruments, but they do not satisfy musicians' needs of precisely reproducing sound quality regardless of the presence or absence of mutes.

CITATION LIST

Patent Literature

PLT 1: Japanese Patent No. 2707913

PLT 2: U.S. Pat. No. 5,438,156, which was filed by claiming priority on the same priority application as PLT 1

PLT 3: U.S. Patent Application Publication No. US 2004/0261602

PLT 4: U.S. Pat. No. 4,998,959

PLT 5: U.S. Pat. No. 5,309,808

PLT 6: U.S. Pat. No. 5,373,771

PLT 7: U.S. Pat. No. 5,488,893

PLT 8: U.S. Pat. No. 5,569,864

PLT 9: U.S. Pat. No. 5,973,246

PLT 10: U.S. Pat. No. 6,114,619

PLT 11: U.S. Pat. No. 7,049,501

PLT 12: Japanese Patent No. 4986091

SUMMARY OF THE INVENTION

It is an object of the present invention to provide a mute detachably attached to a brass instrument, which is able to mute sound but to reproduce resonating property with a high precision without degrading pitches, tone colors, and sound quality.

The present invention relates to a mate detachably attached to a brass instrument which includes a fixed part and at least one branch pipe including a main pipe and art auxiliary pipe. The mute is attached to the tapered portion of a bell pipe of a brass instrument in such a way that the fixed part is interposed between the interior of the bell pipe and the exterior of the main pipe.

The claimed invention is directed to a mute for a brass instrument with a bell pipe, including a main pipe, and at least one auxiliary pipe, wherein the internal space of the main pipe is connected to the internal space of the auxiliary pipe at an interconnect part. Herein, an air flow blown into the bell pipe is introduced into the main pipe, and then the air flow introduced into the main pipe is branched to the auxiliary pipe and emitted from the opening end of the main pipe and the opening end of the auxiliary pipe.

Additionally, it is possible to modify the mute of the present invention with alternative features as follows.

(i) It is possible to arrange the fixed part externally of the main pipe, wherein the fixed part is attached to the tapered portion of the bell pipe of a brass instrument.

(ii) It is possible to separate the auxiliary pipe from the main pipe such that the auxiliary pipe will partly cover the external circumference of the main pipe.

(iii) It is possible to redesign the fixed part to include at least one cavity which may partly transmit, an air flow blown into the bell pipe of a brass instrument.

BRIEF DESCRIPTION OF THE DRAWINGS

These and other objects, aspects, and embodiments of the present invention will be described in more detail with reference to the following drawings.

DESCRIPTION OF THE PREFERRED EMBODIMENT

The present invention will be described in further detail by way of examples with reference to the accompanying drawings.

1. Preferred Embodiment

Figure 1:
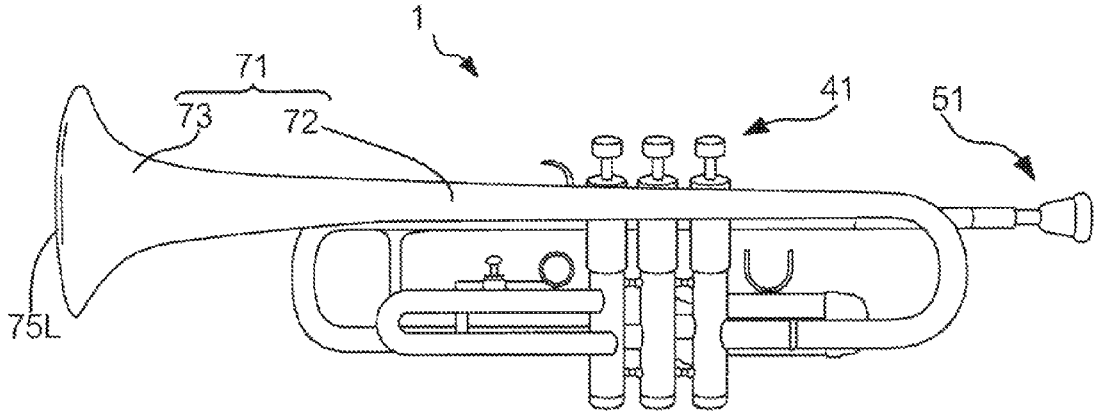
FIG. 1 is a perspective view of a brass instrument equipped with a mute according to a preferred embodiment of the present invention.

FIG. 1 is a perspective view of a brass instrument (or a wind instrument) 1 equipped with a mute 100 according to a preferred embodiment of the present invention. The bass instrument 1 resembles a generally-known brass instrument such as a trumpet and a trombone, which is equipped with a pitch adjuster 41, a mouthpiece 51, and a bell pipe 71. The pitch adjuster 41 includes a piston valve and a bypass pipe. Upon operating the pitch adjuster 41, it is possible to switch over the presence and the absence of routing using the bypass pipe so as to change an effective length of the brass instrument 1. The pitch adjuster 41 is able to adjust the length of an air column resonating inside the bell pipe 71 such that the brass instrument 1 can produce sound having pitches belonging to the predetermined musical scale.

The bell pipe 71 includes a tapered pipe 72 and a bell 73. The tapered pipe 72 is a taper-shaped pipe portion which is elongated and gradually changed in its diameter with a predetermined taper ratio. The bell 73 is a bell-shaped sounder portion whose taper ratio (or whose curvature) is gradually enlarged in an axial direction. A wide-open edge 75L is formed at the distal end of the bell 73 of the bell pipe 71. A player's breath is blown into the internal space of the brass instrument 1 via the mouthpiece 51 and then emitted into the external air via the wide-open edge 75L. An air flow introduced into the brass instrument 1 is not necessarily limited to a player's breath; hence, it is possible to mechanically produce an air flow and introduce it into the brass instrument 1.

Figure 2:
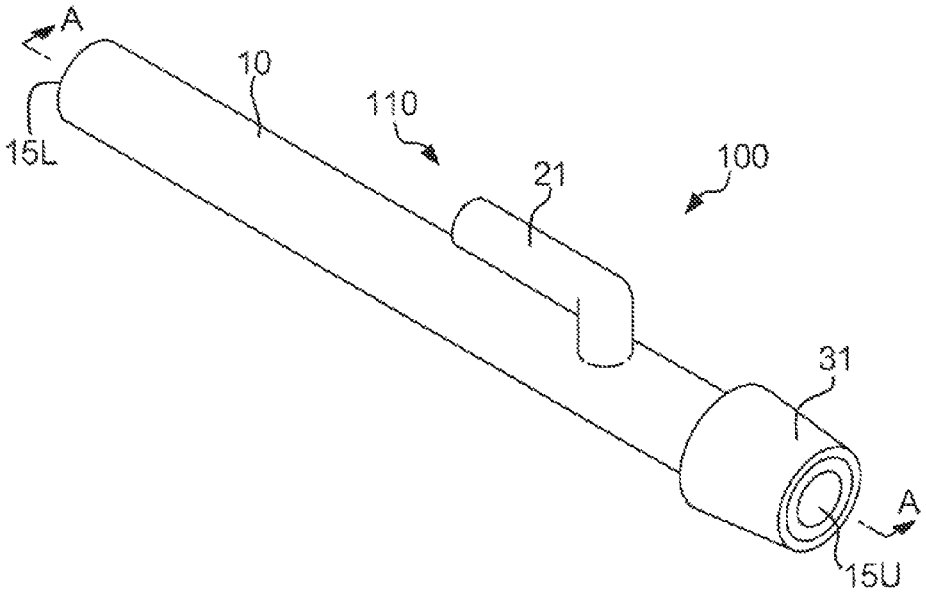
FIG. 2 is a perspective view of the mute shown in FIG. 1.
Figure 3:
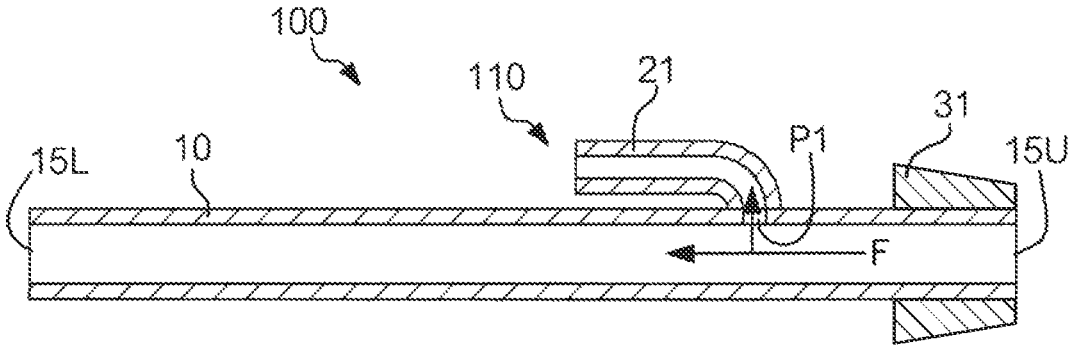
FIG. 3 is a longitudinal sectional view taken along line A-A in FIG. 2.

Next, the mute 100 detachably attached to the brass instrument 1 will be described in detail. FIG. 2 is a perspective view of the mute 100. FIG. 3 is a longitudinal sectional view taken along line A-A in FIG. 2. The mute 100 includes a fixed part 31 and a branch pipe 110 which further includes a main pipe 10 and an auxiliary pipe 21. The main pipe 10 is an elongated pipe with a circular section having a relatively large diameter, whilst the auxiliary pipe 21 is formed using a pipe with a circular section having a relatively small diameter. Herein, these pipes maintain the same cross section entirely in the axial direction; hence, it is possible to employ a straight pipe (which is straightly elongated in its axial direction) or a curved pipe whose cross section is not changed in the axial direction. In either case, these pipes are not changed in their cross-sectional areas so that the same cross section having the same opening area can be secured at any one of normal planes, perpendicular to the axial direction, along the entire length thereof.

The main pipe 10 has an upstream edge 15U which is positioned close to the mouthpiece 51 and a downstream edge 15L which is positioned close to the wide-open edge 75L of the bell 73 when the mute 100 is installed in the brass instrument 1. Herein, a player's breath is blown into the upstream edge 15U and then emitted from the downstream edge 15L. Openings are formed at the distal end of the upstream edge 15U and the distal end of the downstream edge 15L. These openings are sectioned along the planes normal to the axial direction of the mute 100.

The internal space of the main pipe 10 is connected to the internal space of the auxiliary pipe 21 at an interconnect part P1. The auxiliary pipe 21 is elongated in its axial direction which is parallel to the axial direction of the main pipe 10, but the base portion of the auxiliary pipe 21 is bent and connected to the main pipe 10 at the interconnect part P1. In other words, the upstream edge (or the right-side edge) of the auxiliary pipe 21 is connected to the main pipe 10, while the downstream edge (or the left-side edge) of the auxiliary pipe 21 is opened in FIG. 3.

A player's breath blown into the upstream edge 15U of the main pipe 10 is branched away at the interconnect part P1, at which the internal path of the main pipe 10 is partly branched into the auxiliary pipe 21. In FIGS. 2 and 3, the reference sign "F" denotes a flow (or a branched flow) of a player's breath. That is, a player's breath blown into the upstream edge 15U of the main pipe 10 is divided into two flows and then emitted from the downstream edge 15L of the main pipe 10 and the downstream edge of the auxiliary pipe 21.

The fixed part 31 is attached to the main pipe 10 in proximity to the upstream edge 15U of the main pipe 10. The fixed part 31 is formed using a soft material (e.g. a cork or a rubber) which is softer than the material of the main pipe 10. Viewing in the axial direction of the main pipe 10, the fixed part 31 is bonded to the main pipe 10 to cover its external circumference. The thickness of the fixed part 31 is gradually reduced in a direction toward the upstream edge 15U of the main pipe 10; hence, the external shape of the fixed part 31 is a conical shape without its top portion which is truncated. The taper ratio of the external shape of the fixed part 31 approximately matches the taper ratio of the tapered pipe 72 of the bell pipe 71 of the brass instrument 1.

Figure 4:
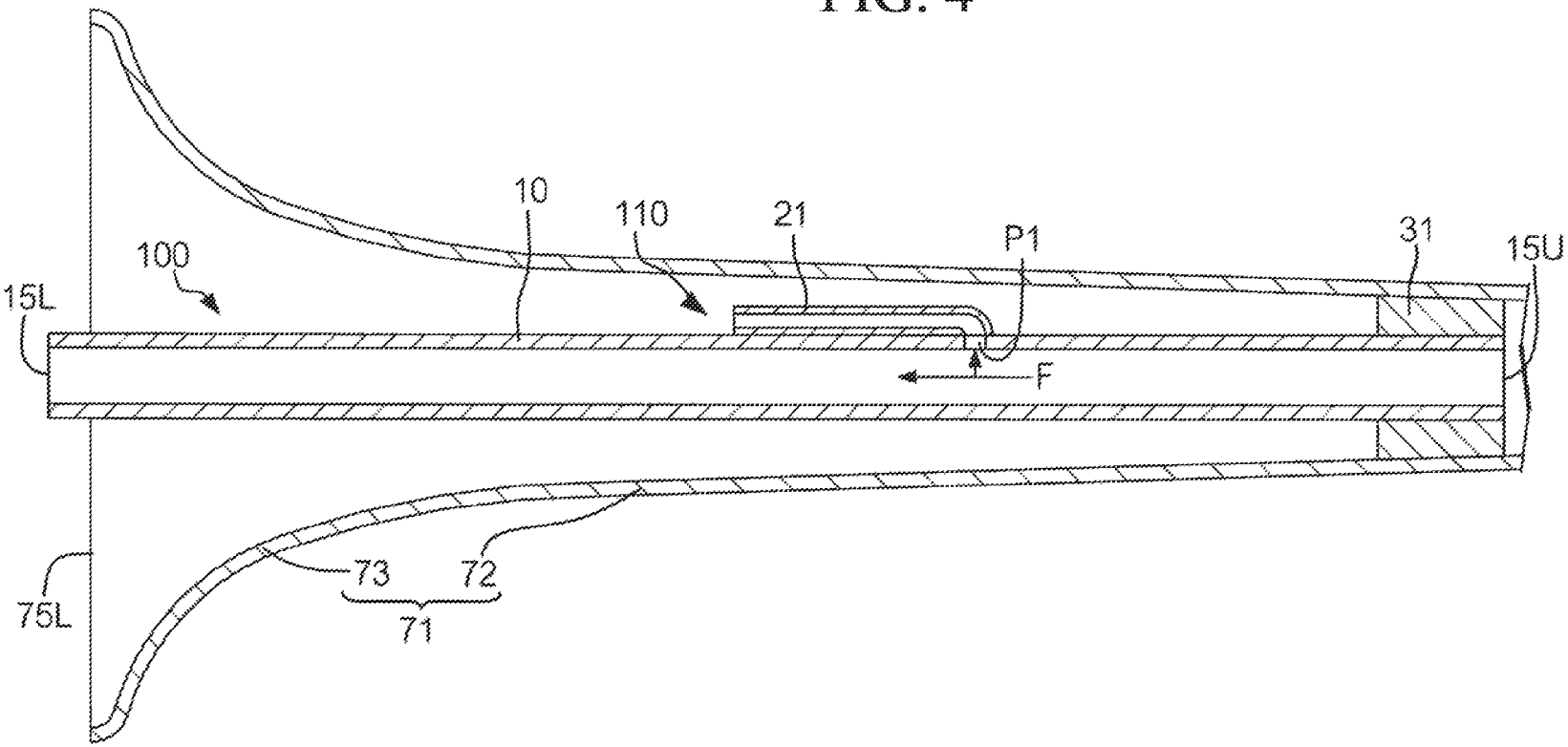
FIG. 4 is a longitudinal sectional view of the brass instrument equipped with the mute.

Next, the brass instrument 1 equipped with the mute 100 will be described in detail in terms of the mechanical structure and the operation. FIG. 4 is a longitudinal sectional view of the brass instrument 1 equipped with the mute 100. The mute 100 is installed inside the bell pipe 71. Specifically, a player holds the mute 100, with the fixed part 31 (or the upstream edge 15L) directing to the internal space of the bell pipe 71, and then inserts it into the wide-open edge 75L of the bell pipe 71. When the mute 100 is completely inserted into the bell pipe 71, the fixed part 31 of the mute 100 is tightly held between the main pipe 10 and the tapered pipe 72 of the bell pipe 71. When being sandwiched between the main pipe 10 and the tapered pipe 72 of the bell pipe 71, the fixed part 31 of the mute 100 fixes the position of the main pipe 10 relative to the brass instrument, so that the mute 100 is fixed in position in connection with the brass instrument 1. The mute 100 is detachably fixed to the brass instrument 1 by means of the fixed part 31 pressed by the main pipe 10 and the tapered pipe 72. For this reason, a player is able to easily pull out the mute 100 from the brass instrument 1 with his/her hand.

The mute 100 is designed with the predetermined shape and dimensions such that the main pipe 10 and the auxiliary pipe 21 (constituting the branch pipe 110) will not come in contact with the interior face of the bell pipe 71 when the mute 100 is attached to the brass instrument 1. FIG. 4 shows that the mute 100 is substantially installed inside the internal space of the bell pipe 71 while the downstream edge 15L of the main pipe 10 of the mute 100 is positioned slightly externally of the wide-open edge 75L of the bell pipe 71; but this is not a restriction. It is possible to determine the shape and the dimensions of the mute 100 such that the mute 100 will be entirely installed inside the internal space of the bell pipe 71. In this case, it is possible to shorten the length of the main pipe 10, or it is possible to form the main pipe 10 by use of a curved pipe or a spirally-curved pipe.

In the brass instrument 1 equipped with the mute 100, the pitch adjuster 41 is able to adjust the length of an air column, resonating inside the bell pipe 71, at the predetermined length in connection with the opening of the downstream edge 15L of the main pipe 10 and the opening of the downstream edge of the auxiliary pipe 21. The brass instrument 1 is able to produce sound with a desired pitch (belonging to a specific musical scale) owing to a resonating air column whose length is adjusted at the predetermined length. In short, the pitch adjuster 41 adjusts the length of a resonating air column so as to produce any one of pitches (belonging to a specific musical scale) in connection with the opening of the downstream edge 15L of the main pipe 10 and the opening of the downstream edge of the auxiliary pipe 21.

The internal space of the branch pipe 110 of the mute 100 is determined in terms of the shape and the dimensions such that the pitch adjuster 41 is able to adjust the length of a resonating air column so as to produce any one of pitches belonging to a specific musical scale regardless of the installation or disconnection of the mute 100 in the brass instrument 1. The present embodiment is designed to determine the length and the sectional area for each of the main pipe 10 and the auxiliary pipe 21 (constituting the branch pipe 110) and the connected position between the main pipe 10 and the auxiliary pipe 23.

In the brass instrument 1 resembling a trombone, for example, the pitch adjuster 41 is designed to continuously change the length of a resonating air column. The brass instrument 1 resembling a trombone may demonstrate a higher degree of freedom in determining the length and the sectional area for each of the main pipe 10 and the auxiliary pipe 21 as well as the connected position between the main pipe 10 and the auxiliary pipe 21 rather than the brass instrument 1 resembling a trumpet. In this case, it is possible to determine the position of a slide pipe (not shown) for generating a specific pitch differently with respect to the brass instrument 1 equipped with the mute 100 and the brass instrument 1 not equipped with the mute 100.

The branch pipe 110 of the mute 100 exhibits various resonating characteristics depending on parameters regarding the shape of the branch pipe 110, such as the connected position (i.e. the interconnect part P1), at which the auxiliary pipe 21 joins to the main pipe 10 in the axial direction, and the shape of the auxiliary pipe 21 (e.g. the length and the sectional area of the internal space). By appropriately setting these parameters, it is possible to reproduce resonating characteristics of the bell pipe 71 having a generally-known bell shape of a trumpet. The mute 100 is able to suppress sound volume produced by the brass instrument 1 due to the straight shape of the downstream edge 15L of the main pipe 100 (which is not enlarged in size and dimensions like a bell shape). That is, the mute 100 allows the brass instrument 1 to reproduce resonating characteristics of the bell pipe 71 while suppressing sound volume. The mute 100 shown in FIG. 4 differs from conventionally mutes such that the branch pipe 110 thereof does not additionally cause unwanted peaks of resonance in the low register; hence, it is possible to improve pitches and tone colors in correspondence with low-degree peaks of resonance.

Conventional mutes are basically designed to highly suppress players' breathes blown into wind instruments; this may significantly change players' blowing sensations in blowing their breaths into wind instruments. In contrast, the mute 100 of the present embodiment does not include a suppressing part for rapidly suppressing a player's breath blown into the brass instrument. This may not differentiate a player's blowing sensation between a mute mode of the brass instrument 1 equipped with the mute 100 and a normal mode of the brass instrument 1 not equipped with the mute 100.

The present embodiment is able to prevent the brass instrument 1 from being changed in sound quality in the mute mode of the brass instrument 1 equipped with the route 100, compared to the normal mode of the brass instrument 1 not equipped with the mute 100. In the mute mode, the present embodiment allows a player to play music with the suppressed sound volume but without changing the sound quality of the brass instrument 1. Additionally, it is possible to reduce variation of a player's blowing sensation between the mute mode and the normal mode. Moreover, it is possible to prevent the mute 100 from being unexpectedly fallen off from the brass instrument 100 because the fixed part 31 of the mute 100 comes in contact with the rear portion of the tapered pipe 72 (which is positioned in the back of the bell pipe 71) so as to support the branch pipe 110.

It is possible to reproduce other resonating characteristics, simulating the other shape of the pipe structure, rather than the bell pipe 71. In this case, it is necessary to redesign the mute 100 with the branch pipe 110 simulating the shape of the internal space of the pipe structure. With the brass instrument 1 equipped with the redesigned mute 100, it is possible to reproduce a variety of sounds of wind instruments. With the brass instrument 1 equipped with the mute 100 exhibiting desired sounding property, a player is able to play music using various sounds according to various playing techniques of wind instruments such as a specific technique of playing a trumpet.

2. Variations

The present invention is not necessarily limited to the foregoing embodiment shown in FIGS. 1 to 4, which can be further modified in various ways.

(a) First Variation

It is possible to modify the foregoing embodiment such that the main pipe 10 is entirely or partly covered the auxiliary pipe 21.

Figures 5A, 5B, 5C:
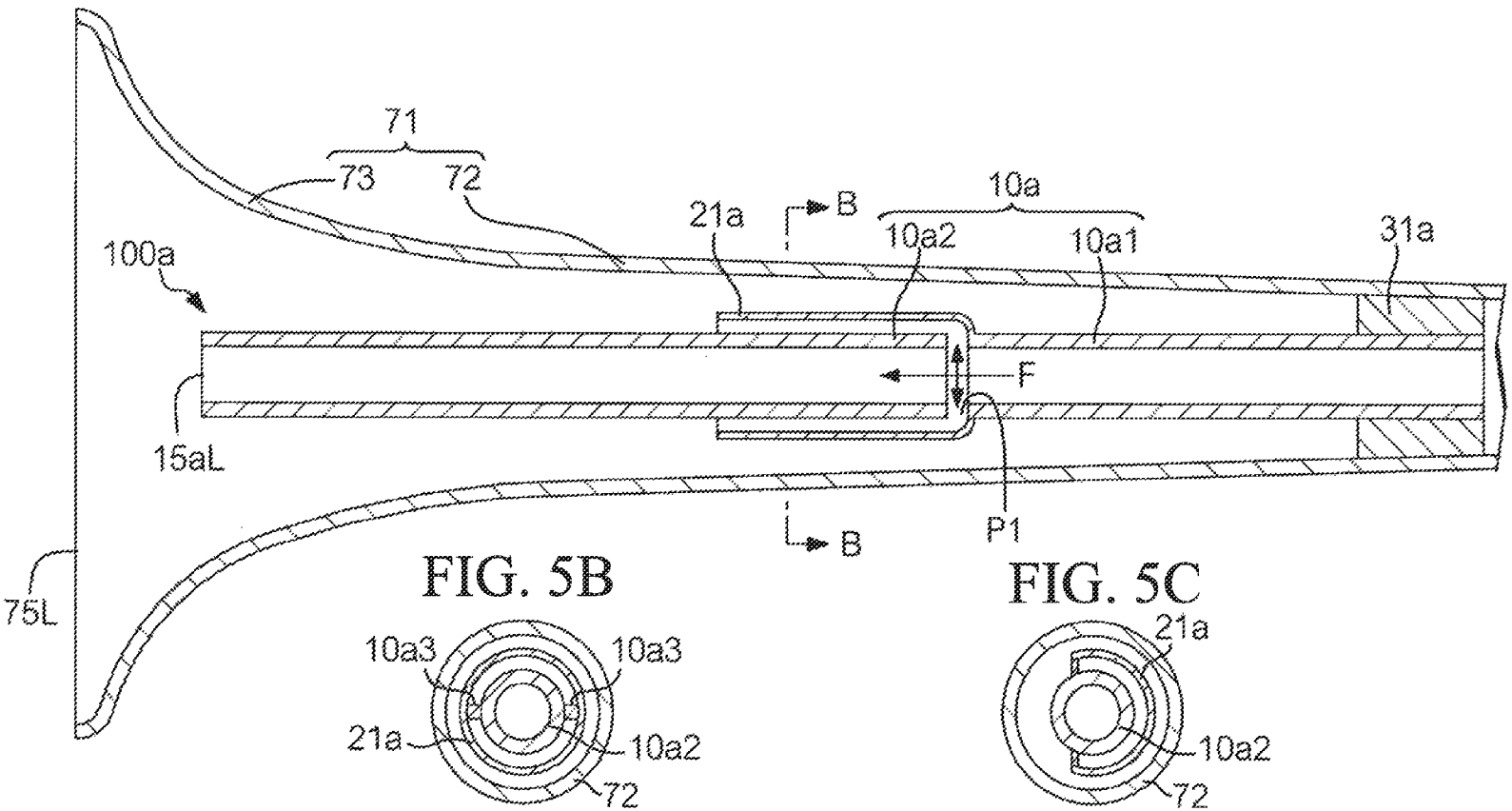
FIG. 5A is a longitudinal sectional view of a brass instrument equipped with a mute according to a first variation.
FIG. 5B is a cross-sectional view taken along line B-B in FIG. 5A.
FIG. 5C is another cross-sectional view taken along line B-B in FIG. 5A.

FIG. 5A is a longitudinal sectional view of the brass instrument 1 equipped with a mute 100*a* according to a first variation. The mute 100*a* includes a main pipe 10*a*, an auxiliary pipe 21*a*, and a fixed part 31*a*. The internal space of the auxiliary pipe 21*a* is connected to the internal space of the main pipe 10*a* at the interconnect part P1. The auxiliary pipe 21*a* is laid to partly cover the exterior of the main pipe 10*a* in its length. Additionally, the auxiliary pipe 21*a* is laid to entirely cover the external circumference of the main pipe 10*a* about the axial direction; hence, the internal space of the auxiliary pipe 21*a* is shaped to match with the exterior shape of the main pipe 10*a*.

The main pipe 10*a* includes a first main pipe 10*a*1 and a second main pipe 10*a*2; which are separated from each other in the initial state. The interconnect part P1 is interposed between the first main pipe 10*a*1. and the second main pipe 10*a*2, which are thus connected together. A player's breath is blown into the main pipe 10*a* and then partly branched into the auxiliary pipe 21*a* because the auxiliary pipe 21*a* is connected to the first main pipe 10*a*1. The auxiliary pipe 21*a* is connected to the second main pipe 10*a*2 via a support 10*a*3.

FIG. 5B is a cross-sectional view taken along line B-B in FIG. 5A. In FIG. SB, the support 10*a*3 is interposed between the second main pipe 10*a*2 and the auxiliary pipe 21*a* partly covering the exterior of the second main pipe 10*a*2. That is, the first main pipe 10*a*1 and the second main pipe 10*a*2 are connected together via the support 10*a*3 and the auxiliary pipe 21*a*; hence, these pipes 10*a*1, 10*a*2, 21*a* and the support 10*a*3 mutually support each other. In this connection, it is possible to replace the support 10*a*3 with another support (not shown) for connecting the first main pipe 10*a*1 and the second main pipe 10*a*2.

FIG. 5C is a cross-sectional view taken along line B-B in FIG. 5A, wherein FIG. 5C shows another connecting structure different from the structure of FIG. 5B. In FIG. 5C, the internal space of the auxiliary pipe 21*a* joins to the internal space of the second main pipe 10*a*2. Viewing in the axial direction, the auxiliary pipe 21*a* partly covers the exterior circumference of the second main pipe 10*a*2 in a certain angle, and therefore the internal space of the auxiliary pipe 21*a* is shaped to match with a certain angle of the exterior circumference of the second main pipe 10*a*2. The connecting structure of FIG. 5C does not need a support interposed between the main pipe 10*a* and the auxiliary pipe 21*a* because the auxiliary pipe 21*a* is directly connected to both of the first main pipe 10*a*1 and the second main pipe 10*a*2. Compared to the auxiliary pipe 21 shown in FIG. 4, the auxiliary pipe 21*a* shown in FIG. 5 has a degree of freedom in changing its position close to the front side of the brass instrument 1. This expands a movable range of the auxiliary pipe 21*a*, thus further increasing the performance ability to produce desired pitches and desired tone colors.

(b) Second Variation

In the foregoing embodiment of FIG. 4, the interconnect part P1 coupled with the auxiliary pipe 21 is fixed to the side face of the main pipe 10; but this is not a restriction. It is possible to arrange the interconnect part P1 inside the internal space of the main pipe 10.

Figure 6:
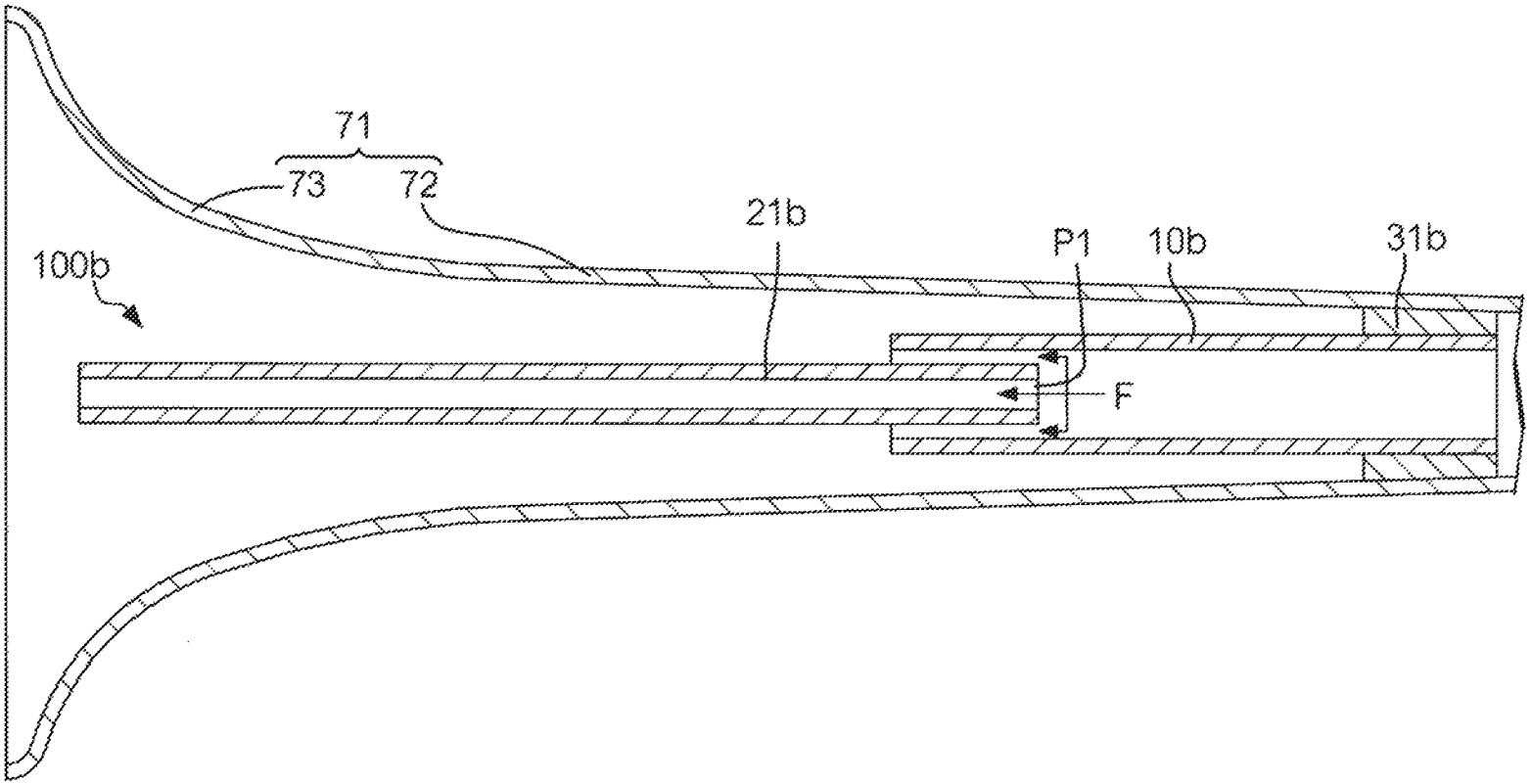
FIG. 6 is a longitudinal sectional view of a brass instrument equipped with a mute according to a second variation.

FIG. 6 is a longitudinal sectional view of the brass instrument 1 equipped with a mute 100*b* according to a second variation. The mute 100*b* includes a fixed part a main pipe 10*b* and an auxiliary pipe 21*b*, both of which are elongated in the axial direction, as well as a fixed part 31*b*. The auxiliary pipe 21*b* having a relatively small diameter and a longer length is partly inserted into the internal space of the main pipe 10*b* having a large diameter; therefore, the internal space of the auxiliary pipe 21*b* is interconnected to the internal space of the main pipe 10*b* at the interconnect part P1. That is, the interconnect part P1, at which the internal space of the main pipe 10*b* is interconnected to the internal space of the auxiliary pipe 21*b*, is not set to the side face of the main pipe 10*b* but set to the inside of the main pipe 10*b*. In this structure, a player's breath blown into the main pipe 10*b* is branched into the internal space of the auxiliary pipe 21*b* at the interconnect part P1. Additionally, a player's breath is partly flown into the space formed between the interior of the main pipe 10*b* and the exterior of the auxiliary pipe 21*b*. The second variation is similar to the first variation of FIG. 5B in that the main pipe 10*b* and the auxiliary pipe 21*b* are connected together via a support (not shown).

(c) Third Variation

In the foregoing embodiment of FIG. 4, the main pipe 10 maintains the same sectional area between the upstream side and the downstream side divided at the interconnect part P1; but it is possible to change the sectional area of the main pipe 10. For example, it is possible to design a mute, including a main pipe and an auxiliary pipe, such that the shape of the upstream side of a main pipe approximately matches with the combined shape consisting of the downstream side of a main pipe and an auxiliary pipe. In this structure, the sectional area of the upstream side of a main pipe differs from the sectional area of the downstream side of a main pipe at an interconnect part.

Figure 7A:
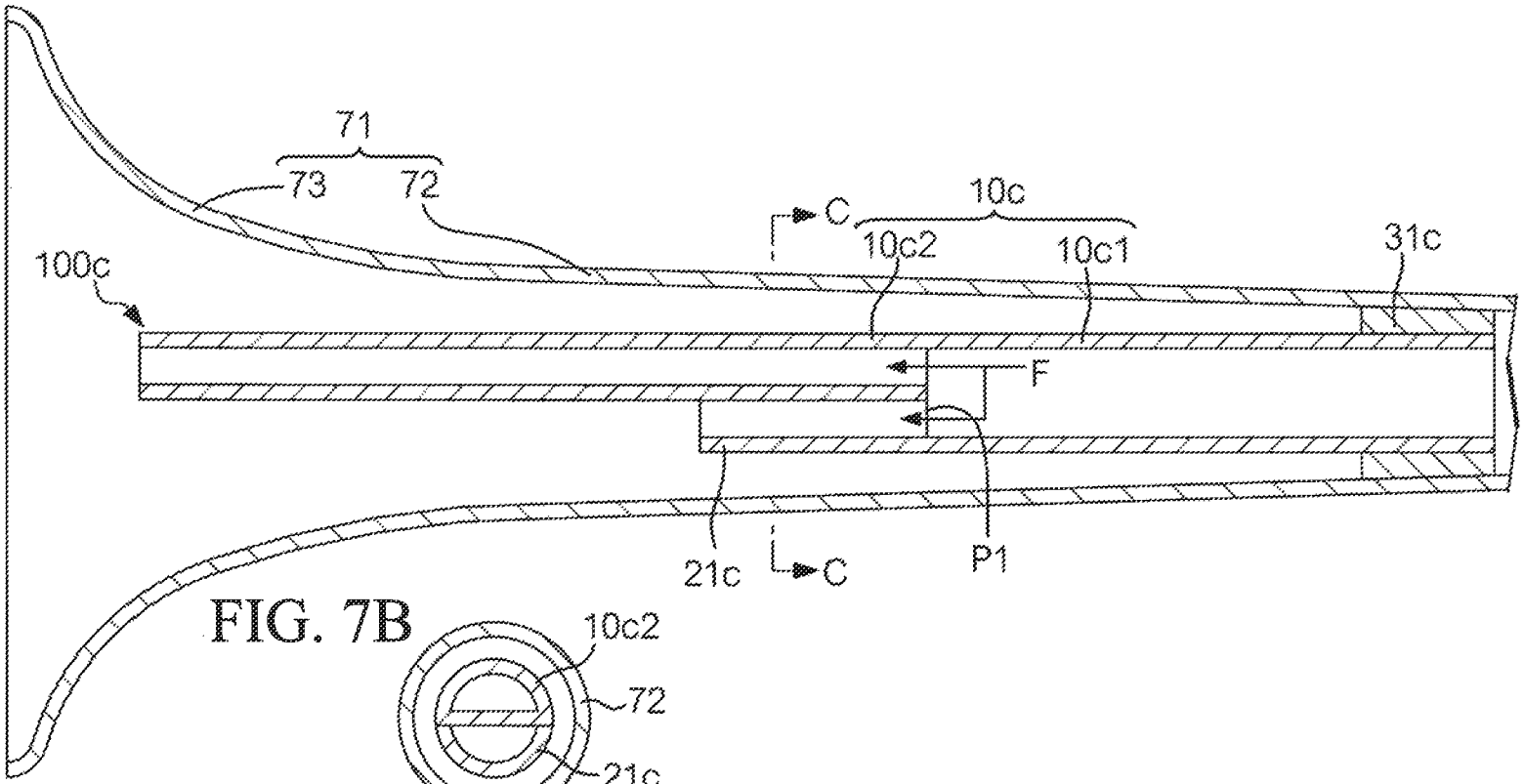
FIG. 7A is a longitudinal sectional view of a brass instrument equipped with a mute according to a third variation.

FIG. 7A is a longitudinal sectional view of the brass instrument 1 equipped with a mute 100*c* according to a third variation. In FIG. 7A, the mute 100*c* includes a main pipe 10*c*, an auxiliary pipe 21*c*, and a fixed part 31*c*. The auxiliary pipe 21*c* is interconnected to the main pipe 10*c* at the interconnect part P1. The main pipe 10*c* includes a first main pipe 10*c*1 (which is laid in the upstream side of the main pipe 10*c*, i.e. the right side from the interconnect part P1) and a second main pipe 10*c*2 (which is laid in the downstream side of the main pipe 10*c*, i.e. the left side from the interconnect part P1). The first main pipe 10*c* 1 has a circular sectional shape.

Figure 7B:
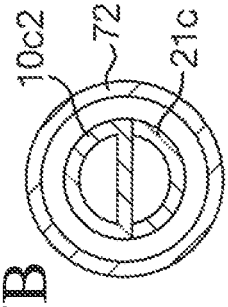
FIG. 7B is a cross-sectional view taken along line C-C in FIG. 7A.

FIG. 78 is a cross-sectional view taken along line C-C in FIG. 7A. In FIG. 7B, both the second main pipe 10*c*2 and the auxiliary pipe 21*c* have a semicircular sectional shape. The second main pipe 10*c*2 and the auxiliary pipe 21*c* are coupled together to form a circular sectional shape which approximately matches with the circular sectional shape of the first main pipe 10*c*1 in the cross-sectional view of FIG. 7B.

(d) Fourth Variation

In the foregoing embodiment, the main pipe 10 and the auxiliary pipe 21 are configured of straight pipes whose sectional areas are unchanged in the axial direction; but it is possible to employ a tapered pipe, a bell-shaped pipe having a certain curvature, or other types of pipes. It is possible to combine a straight pipe with a tapered pipe, or it is possible to combine other types of pipes.

Figure 8:
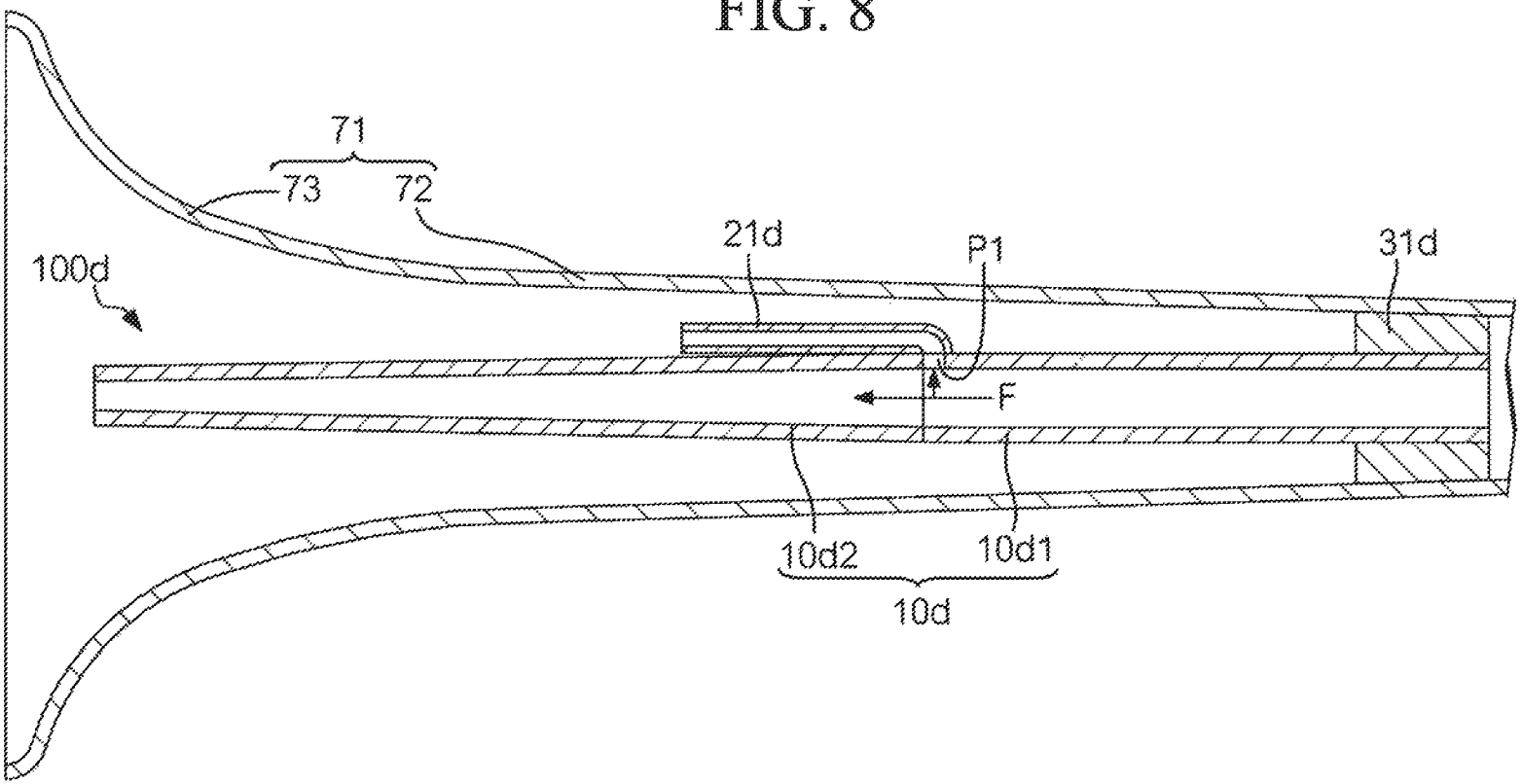
FIG. 8 is a longitudinal sectional view of a brass instrument equipped with a mute having a reverse tapered portion of a main pipe according to a fourth variation.
Figure 9:
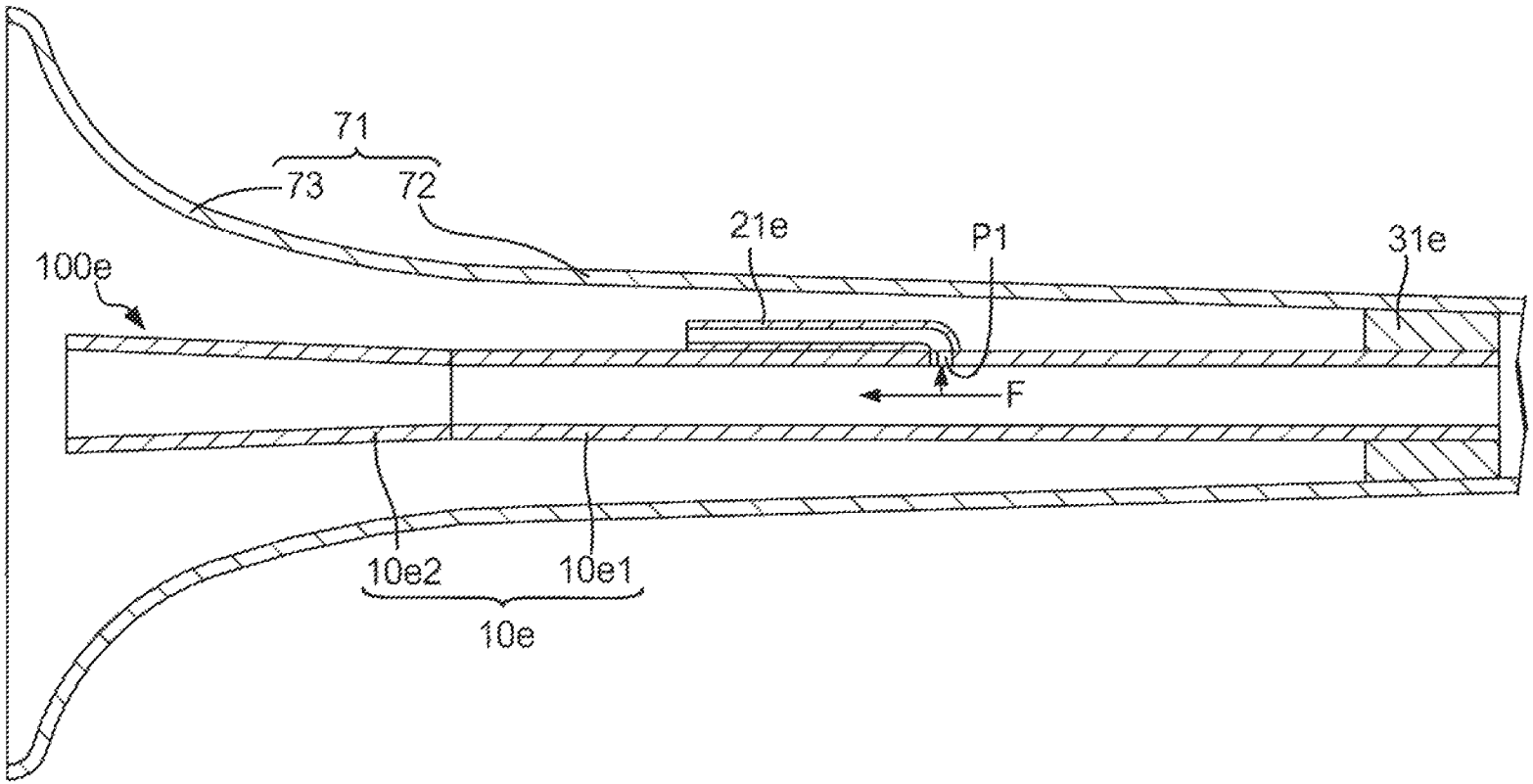
FIG. 9 is a longitudinal sectional view of a brass instrument equipped with another mute having a forward tapered portion of a main pipe according to the fourth variation.
Figure 10:
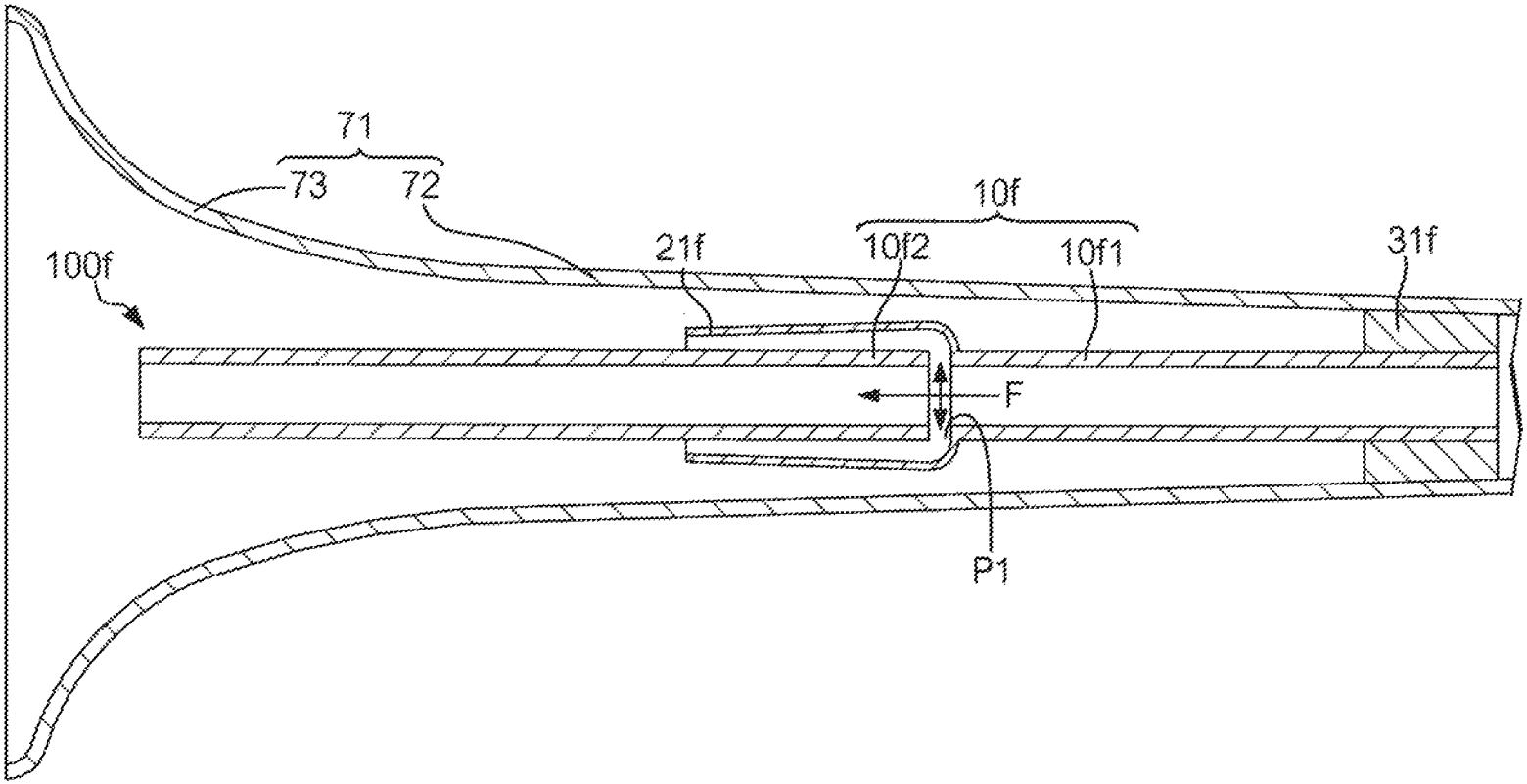
FIG. 10 is a longitudinal sectional view of a brass instrument equipped with another mute having a reverse tapered portion of an auxiliary pipe according to the fourth variation.

Next, three examples according to a fourth variation will be described with reference to FIGS. 8 to 10, wherein FIGS. 8 and 9 show examples utilizing a partially tapered main pipe, and FIG. 10 shows an example utilizing a partially tapered auxiliary pipe.

FIG. 8 is a longitudinal sectional view of the brass instrument 1 equipped with a mute 100*d* according to the fourth variation. The mute 100*d* includes a main pipe 10*d*, an auxiliary pipe 21*d*, and a fixed part 31*d*. The internal space of the auxiliary pipe 21*d* is connected to the internal space of the main pipe 10*d* at the interconnect part P1. The main pipe 10*d* includes a first main pipe 10*d*1 (which is laid in the upstream side of the main pipe 10*d*, i.e. the right side from the interconnect part P1) and a second main pipe 10*d*2 (which is laid in the downstream side of the main pipe 10*d*, i.e. the left side from the interconnect part P1). The second main pipe 10*d*2 is configured of a reverse tapered pipe whose sectional area is gradually decreased towards the distal end. This structure is able to further suppress sound volume of the brass instrument 1 in comparison with the foregoing embodiment. FIG. 8 shows that the boundary between the first main pipe 10*d*1 and the second main pipe 10*d*2 is set to the intermediate position along the main pipe 10*d*; but this is not a restriction. It is possible to set the boundary between the first main pipe 10*d*1 and the second main pipe 10*d*2 to the upstream side or the downstream side of the main pipe 10*d*.

FIG. 9 is a longitudinal sectional view of the brass instrument 1 equipped with a mute 100*e* according to the fourth variation. The mute 100*e* includes a main pipe 10*e*, an auxiliary pipe 21*e*, and a fixed part 31*e*. The internal space of the main pipe 10*e* is connected to the internal space of the auxiliary pipe 21*e* at the interconnect part P1. The main pipe 10*e* includes a first main pipe 10*e*1 (which is laid in the upstream side of the main pipe 10*e*, i.e. the right side from the interconnect part P1) and a second main pipe 10*e*2 (which is laid in the downstream side of the main pipe 10*e*, i.e. the left side from the interconnect part P1). The second main pipe 10*e*2 is configured of a forward tapered pipe whose sectional area is gradually increased towards the distal end. This structure is able to slightly increase sound volume of the brass instrument 1 in comparison with the foregoing embodiment. In other words, it is possible to reduce suppression of sound volume by use of the mute 100*e* compared to the mute 100 of the foregoing embodiment.

FIG. 10 is a longitudinal sectional view of the brass instrument 1 equipped with a mute 100*f* according to the fourth variation. The mute 100*f* includes a main pipe 10*f*, an auxiliary pipe 21*f*, and a fixed part 31*f*. The internal space of the auxiliary pipe 21*f* is connected to the internal space of the main pipe 10*f* at the interconnect part P1. The mute 100*f* of FIG. 10 is a modification of the mute 100*a* of FIG. 5A, wherein the main pipe 10*f* corresponds to the main pipe 10*a* while the auxiliary pipe 21*f* corresponds to the auxiliary pipe 21*a*. In FIG. 10, the auxiliary pipe 21*f* is configured of a reverse tapered pipe whose sectional area is gradually decreased toward the distal end.

These examples illustrate various shapes applicable to branch pipes of mutes; hence, they are not restrictive. It is possible to combine a straight pipe with a forward tapered pipe and a reverse tapered pipe. Additionally, it is possible to arrange the interconnect part P1 not only in a straight portion of a main pipe but also in a forward tapered portion or a reverse tapered portion of a main pipe.

(e) Fifth Variation In the foregoing embodiment, the branch pipe 110 of the mute 100 includes two pipes (i.e. the main pipe 10 and the auxiliary pipe 21) and a single interconnect part P1; but it is possible to combine three or more pipes interconnected at two or more interconnect parts. Three examples according to a fifth variation will be described with reference to FIGS. 11 to 13, each of which illustrates a branch pipe including two auxiliary pipes interconnected to a main pipe at two interconnect parts. Herein, each branch pipe is configured of three pipes, i.e. two auxiliary pipes and one main pipe; but it is possible to redesign each branch pipe arranging four or more pipes.

Figure 11:
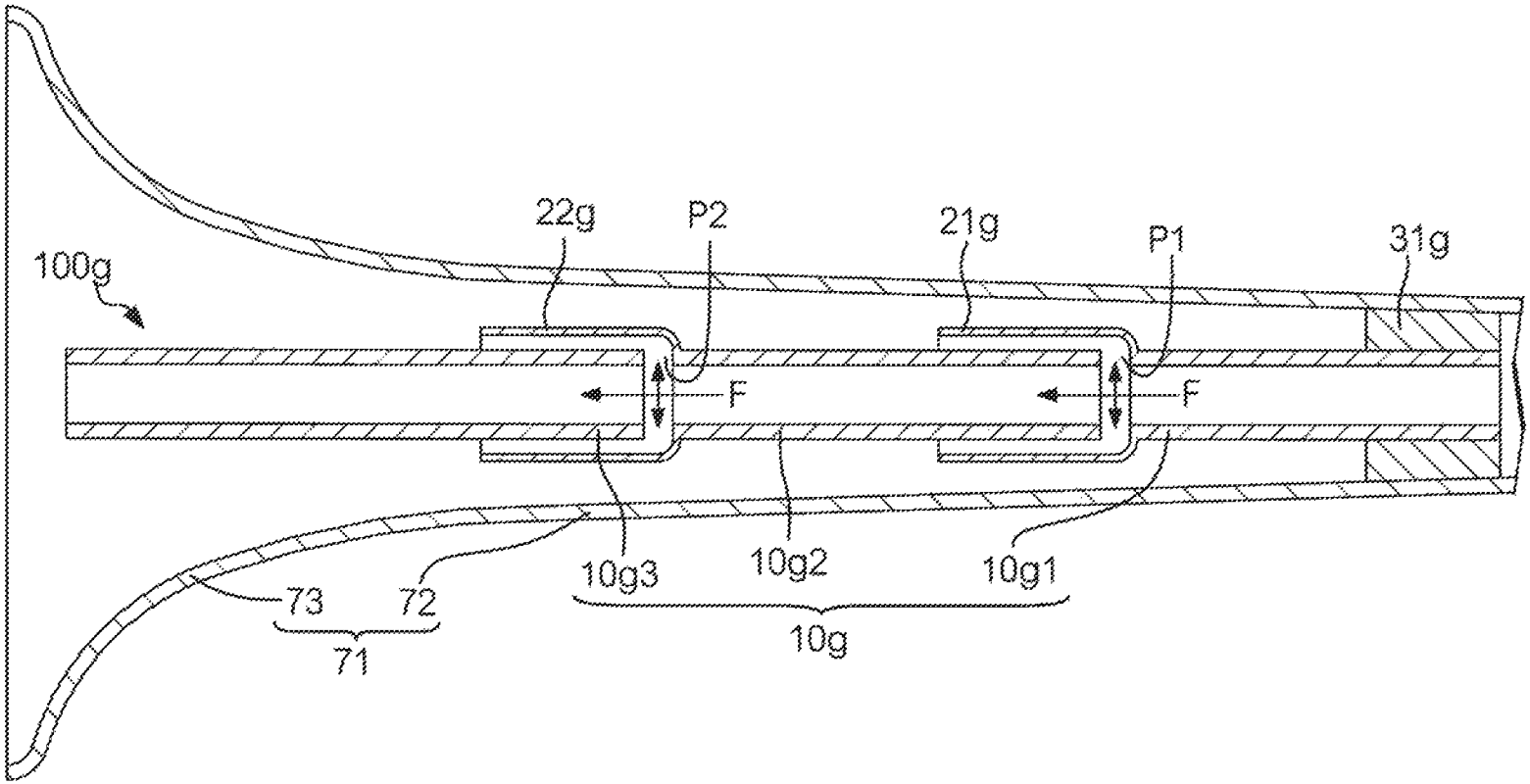
FIG. 11 is a longitudinal sectional view of a brass instrument equipped with a mute having two auxiliary pipes and one main pipe according to a fifth variation.

FIG. 11 is a longitudinal sectional view of the brass instrument equipped with a mute 100*g* according to a fifth variation. The mute 100*g* of FIG. 11 is a modification of the mute 100*a* of FIG. 5A. The mute 100*g* includes a main pipe 10*g*, a first auxiliary pipe 21*g*, a second auxiliary pipe 22*g*, and a fixed part 31*g*. The internal space of the first auxiliary pipe 21*g* is connected to the internal space of the main pipe 10*g* at an interconnect part P1, while the internal space of the second auxiliary pipe 22*g* is connected to the internal space of the main pipe 10*g* at an interconnect part P2. A player's breath blown into the main pipe 10*g* is branched into the first auxiliary pipe 21*g* at the interconnect part P1, at which the first auxiliary pipe 21*g* is connected to the upstream side of the main pipe 10*g*; subsequently, a player's breath propagating inside the main pipe 10*g* after the interconnect part P1 is branched into the second auxiliary pipe 22*g* at the interconnect part P2, at which the second auxiliary pipe 22*g* is connected to the downstream side of the main pipe 10*g*. That is, the mute 100*g* is characterized by arranging the two interconnect parts P1, P2 for branching a player's breath propagating through the main pipe 10*g*.

The main pipe 10*g* includes a first main pipe 10*g*1, a second main pipe 10*g*2, and a third main pipe 10*g*3, which can be separated from each other. A player's breath blown into the main pipe 10*g* is partly branched into the first auxiliary pipe 21*g* at the interconnect part P1 formed between the first main pipe 10*g*1 and the second main pipe 10*g*2. A player's breath propagating through the main pipe 10*g* is partly branched into the second auxiliary pipe 22*g* at the interconnect part P2 formed between the second main pipe 10*g*2 and the third main pipe 10*g*3. Similar to the connecting structure of the first variation shown in FIG. 5A, the first auxiliary pipe 21*g* is connected between the first main pipe 10*g*1 and the second main pipe 10*g*2, while the second auxiliary pipe 22*g* is connected between the second main pipe 10*g*2 and the third main pipe 10*g*3. Compared to the mute 100*a* using a single branch pipe with a single interconnect part, the mute 100*g* having a plurality of branch pipes with a plurality of interconnect parts is able to reproduce resonating characteristics caused with various shapes of pipes.

Figure 12:
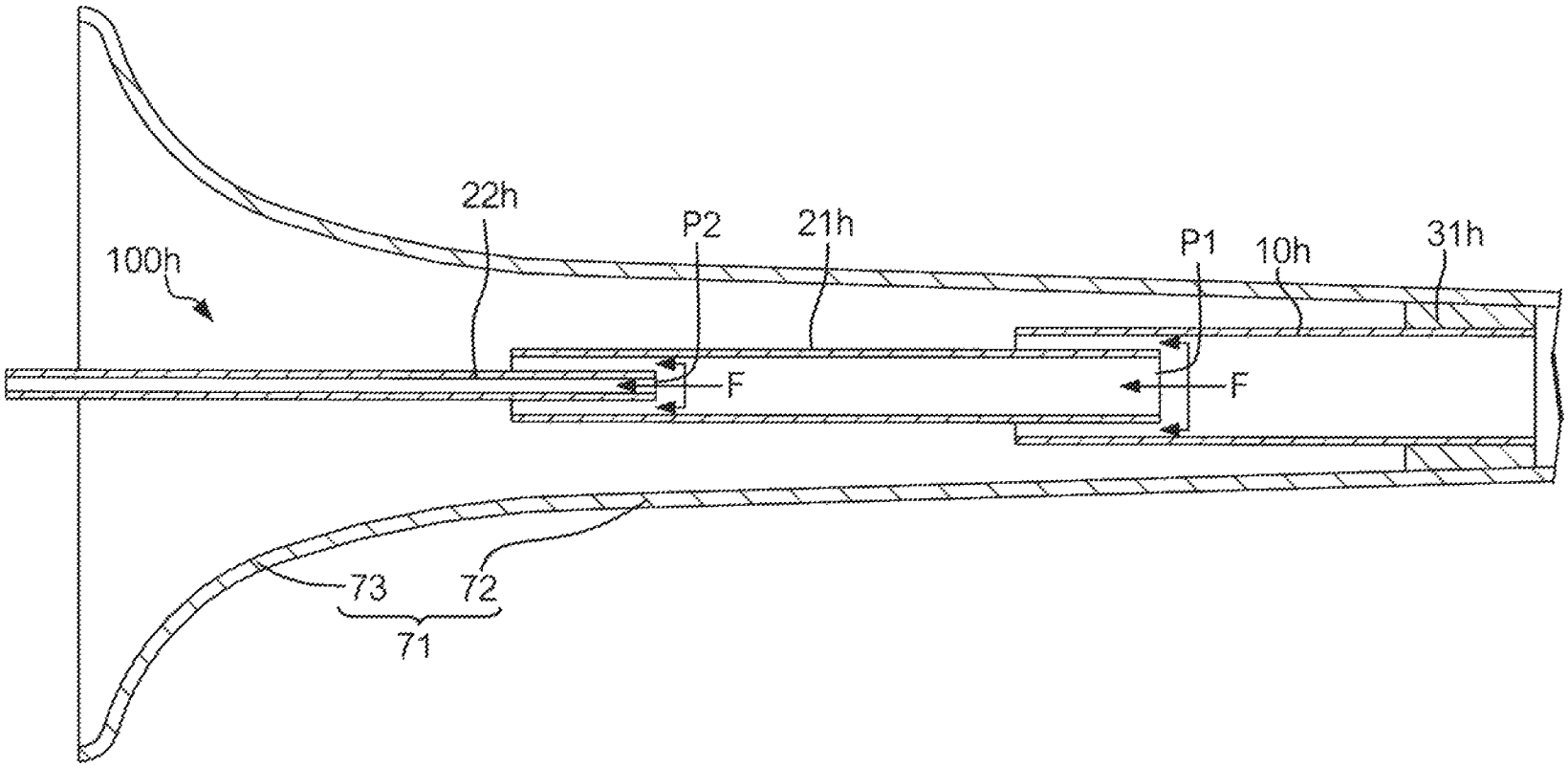
FIG. 12 is a longitudinal sectional view of a brass instrument equipped with another mute having two auxiliary pipes and one main pipe according to the fifth variation.

FIG. 12 is a longitudinal sectional view of the brass instrument 1 equipped with a mute 100*h* according to the fifth variation. The mute 100*h* is a modification of the mute 100*b* of the second variation shown in FIG. 6. The mute 100*h* includes a main pipe 100*h*, a first auxiliary pipe 21*h*, a second auxiliary pipe 22*h*, and a fixed part 31*h*. The internal space of the first auxiliary pipe 21*h* is connected to the internal space of the main pipe 10*h* at the interconnect part P1, while the internal space of the second auxiliary pipe 22*h* is connected to the internal space of the first auxiliary pipe 21*h* at the interconnect part P2. A player's breath blown into the main pipe 10*h* is partly branched into the first auxiliary pipe 21*h* at the interconnect part P1 at which the first auxiliary pipe 21*h* is connected to the main pipe 10*h*. A player's breath propagating through the main pipe 10*h* is partly branched into the second auxiliary pipe 22*h* at the interconnect part P2 at which the second auxiliary pipe 22*h* is connected to the first auxiliary pipe 21*h*. Similar to the connecting structure of the second variation shown in FIG. 6, the first auxiliary pipe 21*h* is connected to the main pipe 10*h* while the second auxiliary pipe 22*h* is connected to the first auxiliary pipe 21*h*.

Figure 13:
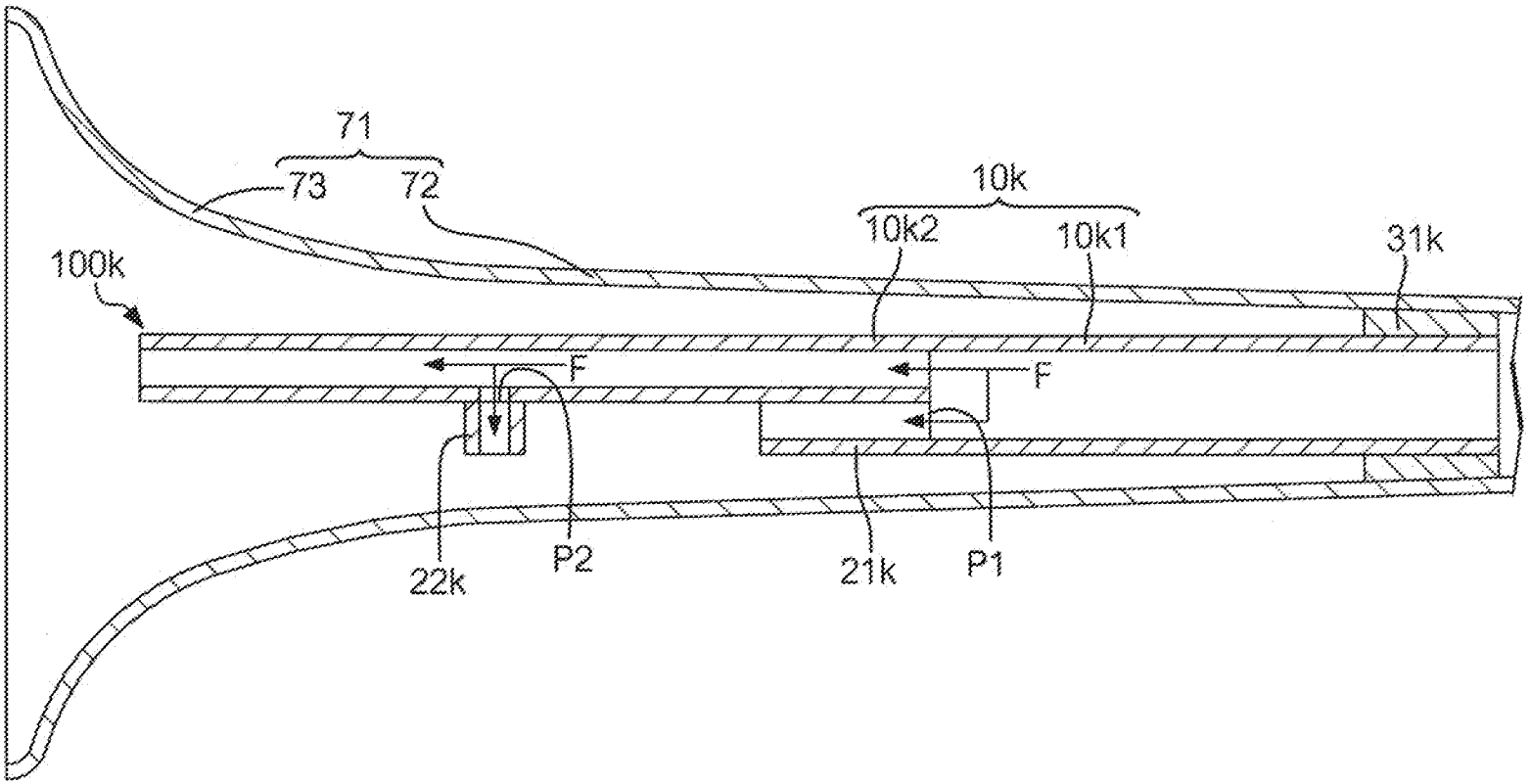
FIG. 13 is a longitudinal sectional view of a brass instrument equipped with another mute having two auxiliary pipes and one man pipe according to the fifth-variation.

FIG. 13 is a longitudinal sectional view of the brass instrument 1 equipped with a mute 100*k* according to the fifth variation. The mute 100*k* is a modification of the mute 100*c* of the third variation shown in FIG. 7. The mute 100*k* includes a main pipe 10*k*, a first auxiliary pipe 21*k*, a second auxiliary pipe 22*k*, and a fixed part 31*k*. The main pipe 10*k* includes a first main pipe 10*k*1 having a large sectional area and a second main pipe 10*k*2 having a small sectional area. The internal space of the first auxiliary pipe 21*k* is connected to the internal space of the first main pipe 10*k*1 at the interconnect part P1, while the internal space of the second auxiliary pipe 22*k* is connected to the internal space of the second main pipe 10*k*2 at the interconnect part P2. A player's breath blown in to the first main pipe 10*k* 1 is partly branched into the first auxiliary pipe 21*k* at the interconnect part P1 at which the first auxiliary pipe 21*k* is connected to the first main pipe 10*k*1, wherein a part of a player's breath propagating through the first main pipe 10*k*1 is introduced into the second main pipe 10*k*2. A player's breath propagating through the second main pipe 10*k*2 is partly branched into the second auxiliary pipe 22*k* at the interconnect part P2 at which the second auxiliary pipe 22*k* is connected to the second main pipe 10*k*2. The connecting structure formed between the first main pipe 10*k*1, the second main pipe 10*k*2, and the first auxiliary pipe 21*k* shown in FIG. 13 is similar to the connecting structure formed between the first main pipe 10*c*1, the second main pipe 10*c*2, and the auxiliary pipe 21*c* shown in FIG. 7. The second auxiliary pipe 22*k* is connected to the lower side face of the second main pipe 10*k*2, wherein the second auxiliary pipe 22*k* is deviated in position from the axial direction of the bell pipe 71. It is possible to effectively utilize the internal apace of the bell pipe 71 when the second auxiliary pipe 22*k* is extended in the axial direction of the bell pipe 71 in connection with the second main pipe 10*k*2. In this connection, it is possible to combine two pipes having different sectional areas serving as an upstream side and a downstream side of the second main pipe 10*k*2 divided at the interconnect part P2.

(f) Sixth Variation

In the foregoing embodiment, the fixed part 31 of the mute 100 is filled in the gap between the exterior of the main pipe 10 and the interior of the bell pipe 71 so that a player's breath is entirely flown into the main pipe 10; but this is not a restriction. It is possible to redesign the mute 100 such that a part of a player's breath may be flown into the gap between the exterior of the main pipe 10 and the interior of the bell pipe 71.

Figures 14A, 14B:
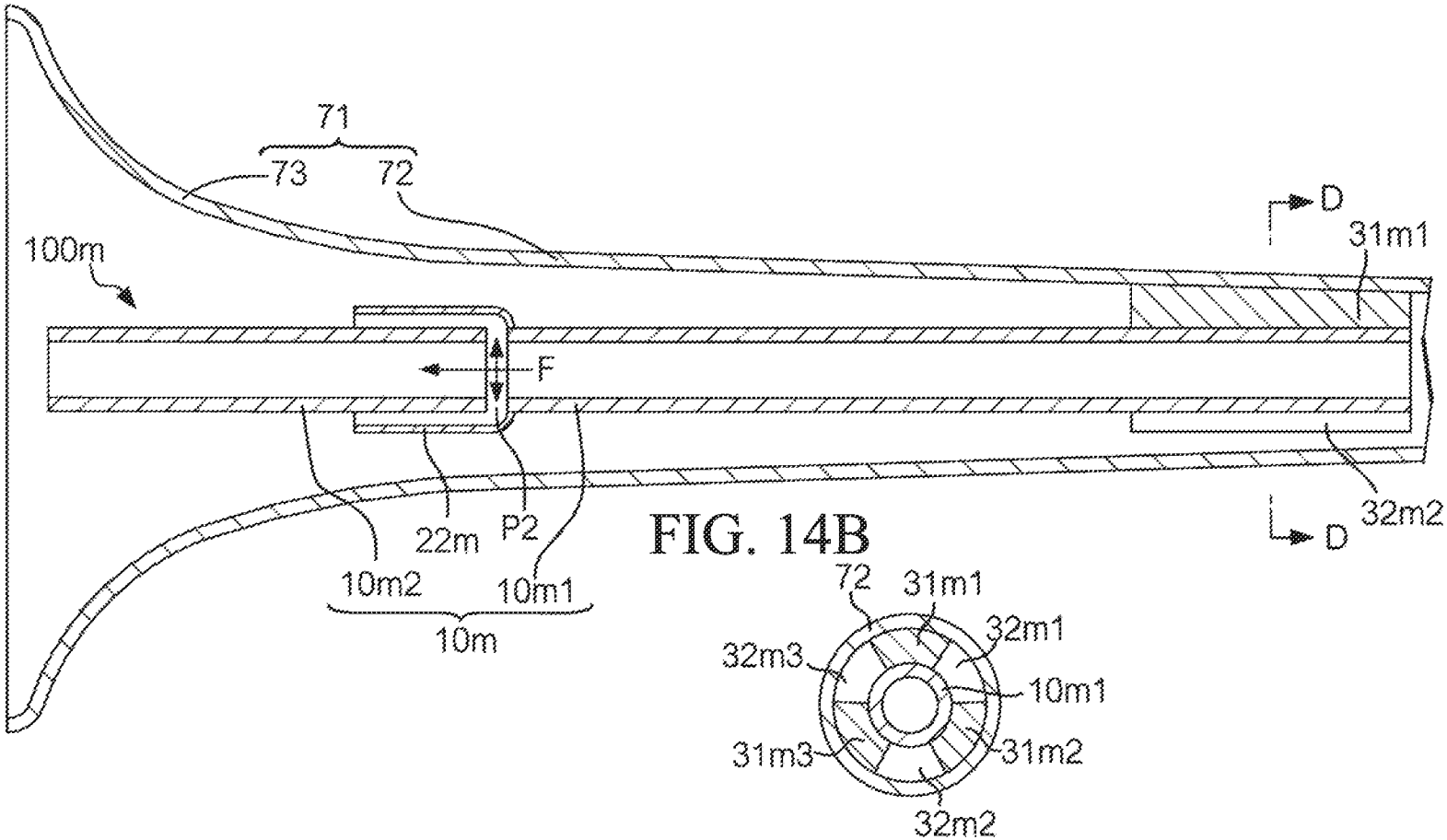
FIG. 14A is a longitudinal sectional view of a brass instrument equipped with a mute having one auxiliary pipe and one main pipe according to a sixth variation.
FIG. 14B is a cross-sectional view taken along line D-D in FIG. 14A.

FIG. 14A is a longitudinal sectional view of the brass instrument 1 equipped with a mute 100*m* according to a sixth variation. The mute 100*m* is a modification of the mute 100*g*, precluding the first auxiliary pipe 21*g* and modifying the fixed part 31*g*. The mute 100*m* includes a main pipe 10*m*, an auxiliary pipe 22*m*, and fixed parts 31*m* having internal spaces 32*m* (i.e. three fixed parts 31*m*1, 32*m*1, 31*m*3 having internal spaces 32*m*1, 32*m*2, 32*m*3). The internal space of the auxiliary pipe 22*m* is connected to the internal space of the main pipe 10*m* at the interconnect part P2, wherein the main pipe 10*m* includes a first main pipe 10*m*1 and a second main pipe 10*m*2.

FIG. 14B is a cross-sectional view taken along line D-D in FIG. 14A. In FIG. 14B, the mute 100*m* includes the three fixed parts 31*m*1, 31*m*2, 31*m*3. The fixed parts 31*m*1, 31*m*2, 31*m*3 are interposed between the tapered pipe 72 of the bell pipe 71 and the first main pipe 10*m*1 such that they are placed in contact with the interior of the tapered pipe 72 and the exterior of the first main pipe 10*m*1, whilst the internal spaces 32*m*1, 32*m*2, 32*m*3 are defined between the interior of the tapered pipe 72 and the exterior of the first main pipe 10*m*1 in proximity to the fixed parts 31*m*1, 31*m*2, 31*m*3. The upstream edges of the internal space 32*m*1, 32*m*2, 32*m*3 are placed in connection with the upstream edge of the first main pipe 10*m*1. Thus, a player's breath is flown into the first main pipe 10*m*1 while partly branched into the internal spaces 32*m*1, 32*m*2, 32*m*3. The sum of the sectional areas of the upstream edges of the internal spaces 32*m*1, 32*m*2, 32*m*3 is smaller than the sectional area of the first main pipe 10*m*1.

Figure 15A:
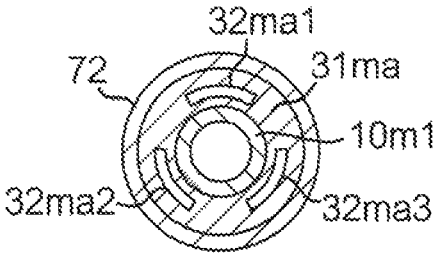
FIG. 15A is a cross-sectional view of a first modification relating to formation of internal spaces in a fixed part applicable to the mute of the sixth variation.
Figure 15B:
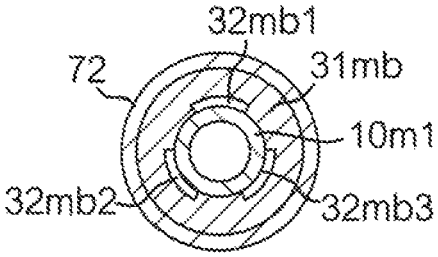
FIG. 15B is a cross-sectional view of a second modification relating to formation of internal spaces in a fixed part applicable to the mute of the sixth variation.
Figure 15C:
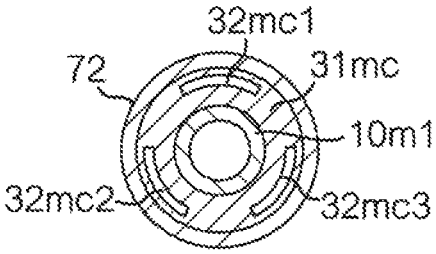
FIG. 15C is a cross-sectional view of a third modification relating to formation of internal spaces in a fixed part applicable to the mute of the sixth variation.

Next, other modifications of the trinary fixed parts with internal spaces formed between the exterior of the first main pipe 10*m*1 and the interior of the tapered pipe 72 will be described with reference to FIGS. 15A to 15C. FIGS. 15A to 15C are cross-sectional views sowing modified examples of the fixed parts 31*m* according to the sixth variation.

FIG. 15A shows a fixed part 31*ma* with internal spaces 32*ma*1, 32*ma*2, 32*ma*3 which are formed not using the interior of the tapered pipe 72 and the exterior of the first main pipe 10*m*1. The internal spaces 32*ma*1, 32*ma*2, 32*ma*3 are formed inside the fixed part 31*ma*, and therefore they are not placed in contact with the interior of the tapered pipe 72 and the exterior of the first main pipe 10*m* 1.

FIG. 15B shows a fixed part 31*mb* with internal spaces 32*mb*1, 32*mb*2, 32*mb*3 winch are formed using the exterior of the first main pipe 10*m*1 but not using the interior of the tapered pipe 72, The internal spaces 32*mb*1, 32*mb*2, 32*mb*3 are formed inside the fixed part. 32*mb* in connection with the exterior of the first main pipe 10*m*1, but they are not placed in contact with the exterior of the tapered pipe 72.

FIG. 15C shows a fixed part 31*mc* with internal spaces 32*mc*1, 32*mc*2, 32*mc*3 which are formed using the interior of the tapered pipe 72 but not using the exterior of the first main pipe 10*m*1. The internal spaces 32*mc*1, 32*mc*2, 32*mc*3 are formed inside the fixed part 31*mc* in contact with the interior of the tapered pipe 72, but they are not placed in contact with the exterior of the first main pipe 10*m*1.

As described above, it is possible to propose various examples regarding formation of internal spaces of fixed parts allowing a player's breath to partly transmit therethrough. It is possible to combine these examples regarding formation of internal spaces of fixed parts. For example, it is possible to arrange three fixed parts having internal spaces shown in FIGS. 15A, 15B, 15C in the gap between the interior of the tapered pipe 72 and the exterior of the main pipe 10*m*.

Due to the internal spaces (or cavities) formed inside the fixed parts, the sixth variation is able to reduce resistance to an air flow owing to the fixed parts rather than the foregoing fixed parts precluding internal spaces, thus improving a user's blowing sensation with playing a brass instrument.

(g) Seventh Variation

If Is possible to modify the nude 100*g* of the fifth embodiment such that the first auxiliary pipe 21*g* and the second auxiliary pipe 22*g* are combined together via their internal spaces communicating with each other.

Figure 16:
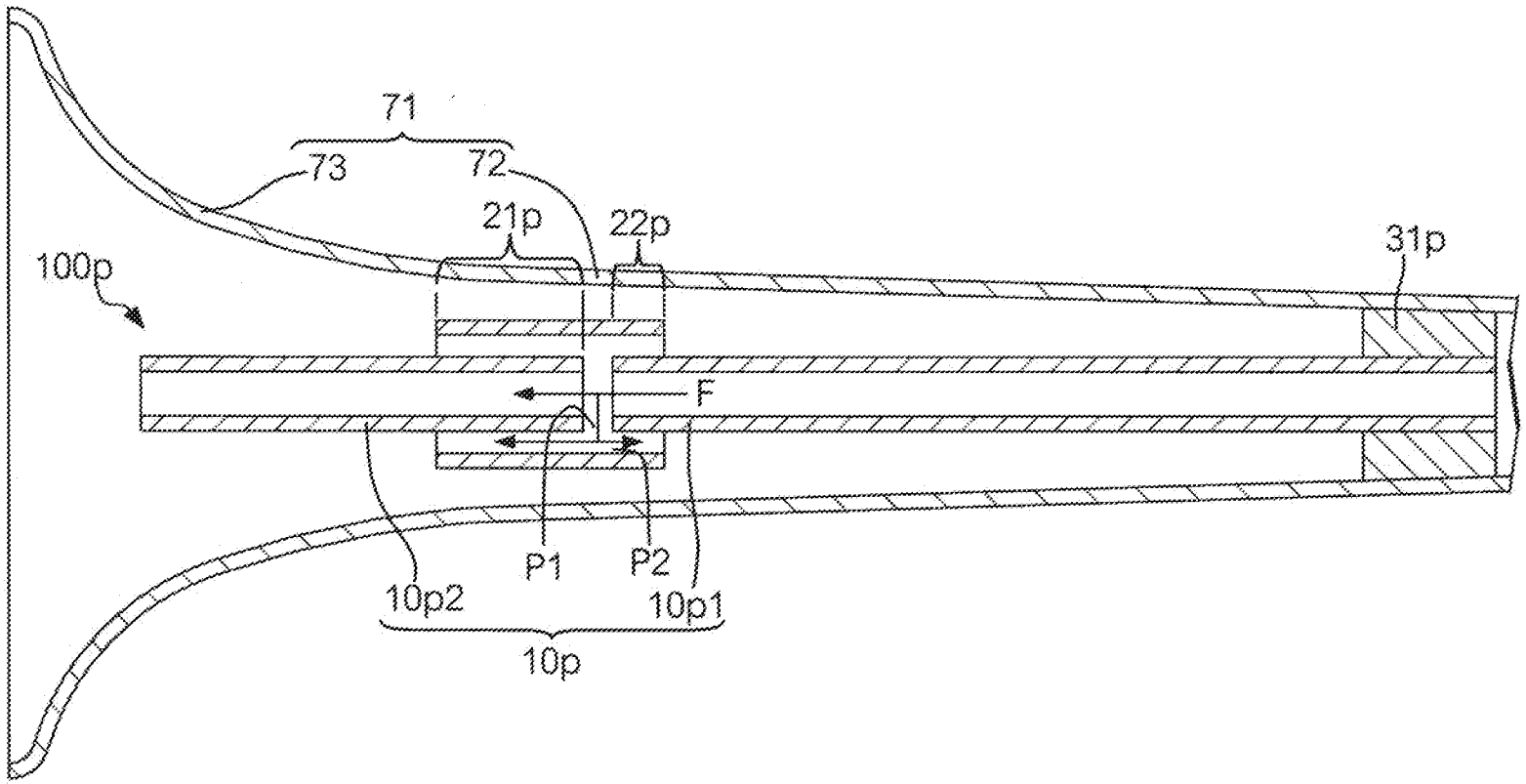
FIG. 16 is a longitudinal sectional view of a brass instrument equipped with a mute according to a seventh variation.

FIG. 16 is a longitudinal sectional view of the brass instrument 1 equipped with a mute 100*p* according to a seventh variation. The mute 100*p* includes a main, pipe top, a first auxiliary pipe 21*p*, a second auxiliary pipe 22*p*, and a fixed part 31*p*. The main pipe 10*p* includes a first main pipe 10*p*1 and a second main pipe 10*p*2, which can be separated from each other. The internal space of the first auxiliary pipe 21*p* is connected to the internal space of the main pipe 10*p* at the interconnect part P1, while the internal space of the second auxiliary pipe 22*p* is connected to the internal space of the first auxiliary pipe 21*p* at the interconnect part P2. Herein, the first auxiliary pipe 21*p* partially covers the second main pipe 10*p*2, while the second auxiliary pipe 22*p* partially covers the first main pipe 10*p*1.

A player's breath blown into the main pipe 10*p* is partially branched into the first auxiliary pipe 21*p* at the interconnect part P1 at which the first main pipe 10*p*1 is connected to the second main pipe 10*p*2. Additionally, a player's breath branched into the first auxiliary pipe 21*p* is partially branched into the second auxiliary pipe 22*p* at the interconnect part P2 at which the first auxiliary pipe 21*p* is connected to the second auxiliary pipe 22*p*. Similar to the connecting structure of the first variation shown in FIG. 5B, the first auxiliary pipe 21*p* and the second auxiliary pipe 22*p* are fixed to the main pipe 10*p* by use of supports (not shown).

In FIG. 16, the interconnect parts P1, P2 are placed in proximity to each other in connection with the integrally unified branch pipe; but this is not a restriction. It is possible to determine the interconnect pans P1, P2 at different positions in connection with different pipes.

Figure 17:
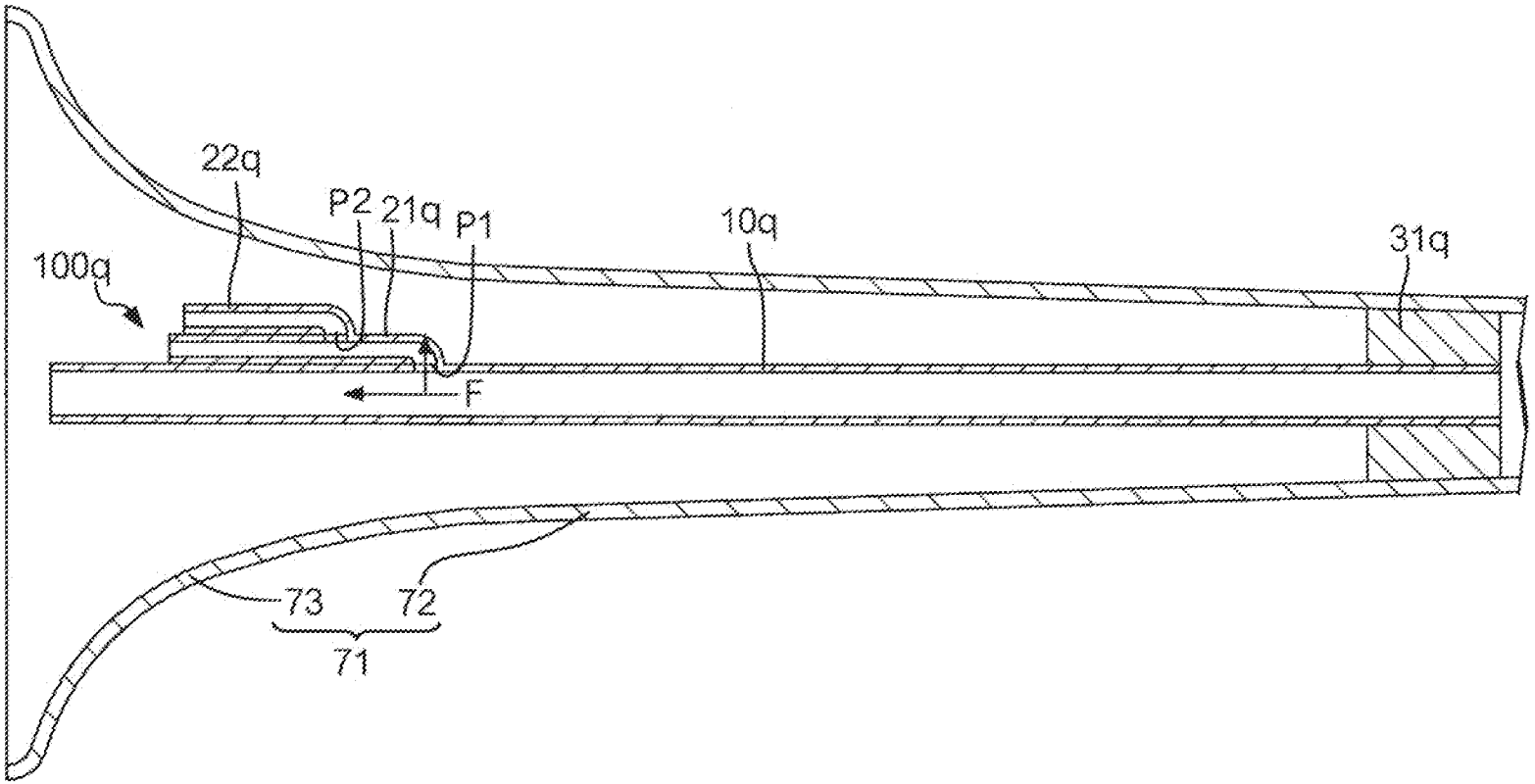
FIG. 17 is a longitudinal sectional view of a brass instrument equipped with another mute according to the seventh variation.

FIG. 17 is a longitudinal sectional view of the brass instrument 1 equipped with a mute 100*q* according to the seventh variation. The mute 100*q* includes a main pipe 10*q*, a first auxiliary pipe 21*q*, a second auxiliary pipe 22*q*, and a fixed part 31*q*. The internal space of the first auxiliary pipe 21*q* is connected to the internal space of the main pipe 10*q* at the interconnect part P1, while the internal space of the second auxiliary pipe 22*q* is connected to the internal space of the first auxiliary pipe 21*q* at the interconnect part P2. A player's breath blown into the main pipe 10*q* is partly branched into the first auxiliary pipe 21*q* at the interconnect part P1. A player's breath branched into the first auxiliary pipe 21*q* is partly branched into the second auxiliary pipe 22*q* at the interconnect part P2.

(h) Eighth Variation

In the foregoing embodiment, the mute 100 includes a plurality of pipes which are integrally unified together; but this is not a restriction. It is possible to design a mute with a main pipe constituted of a plurality of detachably connectible components.

Figure 18:
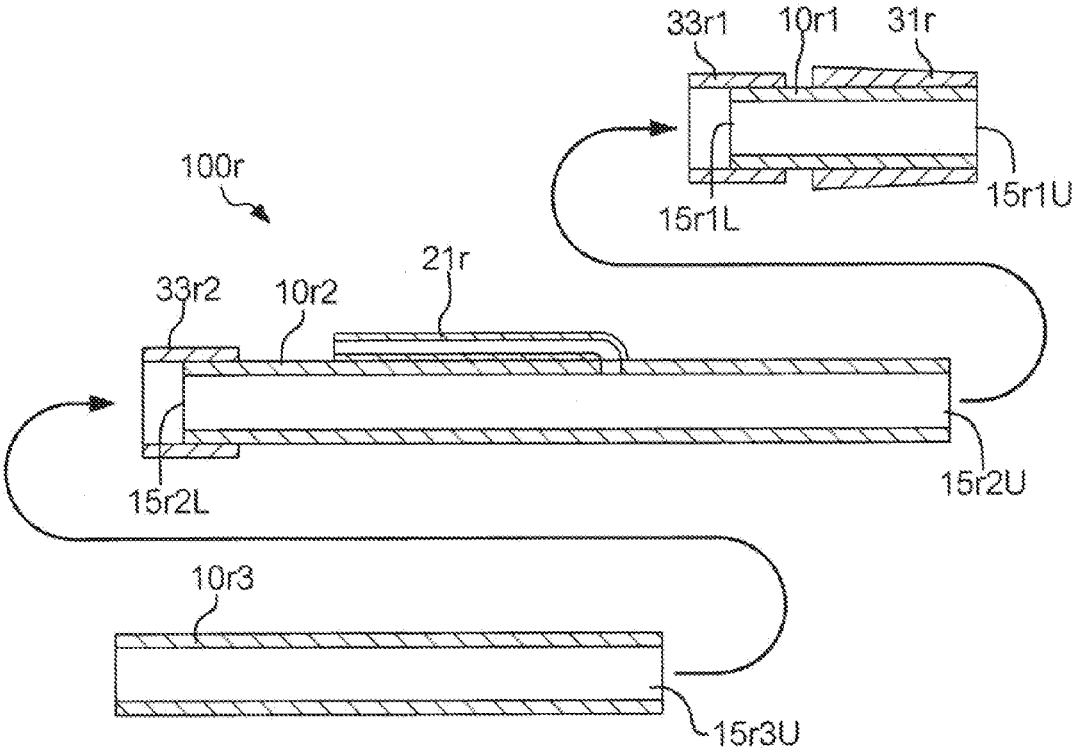
FIG. 18 is a longitudinal sectional view of a brass instrument equipped with a mute according to an eighth variation.
Figure 19:
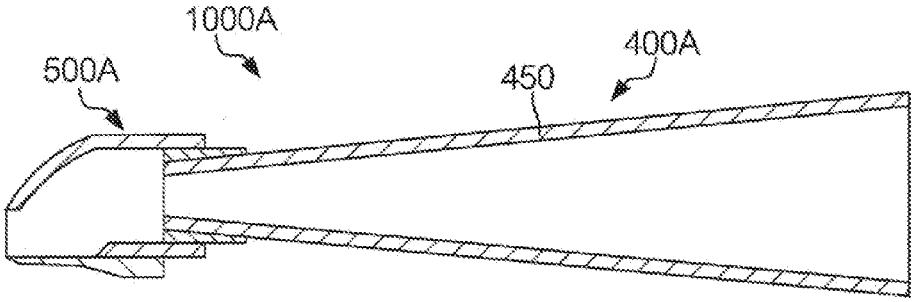
FIG. 19 is a longitudinal sectional view of a conventional wind instrument with a mouthpiece and a tapered pipe.
Figure 20:
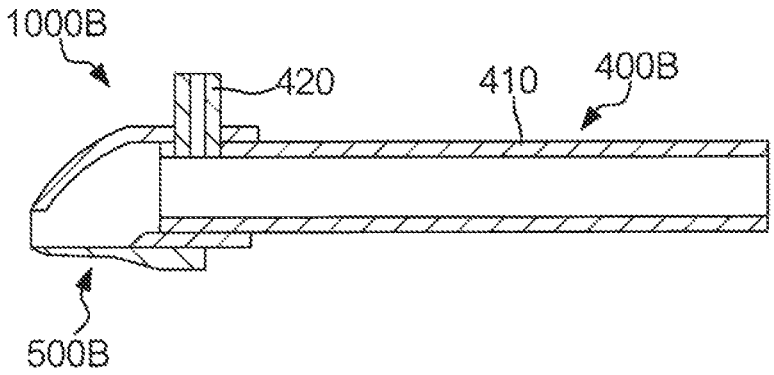
FIG. 20 is a longitudinal sectional view of a conventional wind instrument simulating the resonating property of a tapered pipe with a branch pipe combining straight pipes having different dimensions.

FIG. 18 is a longitudinal sectional view of a mute 100*r* according to an eighth variation. The mute 100*r* includes a first main pipe 10*r*1, a second main pipe 10*r*2, a third main pipe 10*r*3, an auxiliary pipe 21*r*, a fixed part 31*r*, a first connector 33*r*1, and a second connector 33*r*2. The internal space of the auxiliary pipe 21*r* is connected to the internal space of the second main pipe 10*r*2. The fixed part 31*r* is attached to an upstream edge 15*r*1U of the first main pipe 10*r*1. The first connector 33*r*1 is attached to a downstream edge 15*r*1L of the first main pipe 10*r*1. The downstream edge 15*r*1L of the first main pipe 10*r*1 is connected to an upstream edge 15*r*2U of the second main pipe 10*r*2 via the first connector 33*r*1. The second connector 33*r*2 is attached to a downstream edge 15*r*2L of the second main pipe 10*r*2. The downstream edge 15*r*2L of the second main pipe 10*r*2 is connected to an upstream edge 15*r*3U of the third main pipe 10*r*3 via the second connector 33*r*2.

It is possible to realize the same constitution as the route 100 when the first main pipe 10*r*1, the second main pipe 10*r*2, and the third main pipe 10*r*3 are connected together by means of the first connector 33*r*1 and the second connector 33*r*2. The mute 100*r* of the eighth variation is advantageous in terms of portability because the mute 100*r* can be easily disassembled into three components (i.e. the three main pipes 10r1, 10*r*2, 10*r*3) which are small enough to be collectively kept in a case or the like. In this connection, it is possible to modify the mute 100*r* such that the auxiliary pipe 21*r* can be detachably attached to the second main pipe 10*r*2.

(i) Ninth Variation

In the foregoing embodiment, the fixed part 31 is interposed between the main pipe 10 and the tapered pipe 72; but this is not a restriction. It is possible to modify the fixed part 31 to be interposed between the bell 72 and the main pipe 10 according to a ninth variation. In this modification, a player's breath is temporarily broadened inside the internal space of the bell 73 having a large sectional area and then flown into the internal space of the main pipe 10 having a small sectional area. The ninth variation may alter a player's blowing sensation in comparison with the foregoing embodiment.

(j) Tenth Variation

In the foregoing embodiment, the branch pipe 110 of the mute 100 includes a plurality of pipes each of which having an opening at one edge; but this is not a restriction. It is possible to form an opening on the side face of each pipe according to a tenth variation. The tenth variation does not need an opening at one edge of each pipe, which is replaced with an opening on the side face.

(k) Eleventh Variation

In the foregoing embodiment, the mute 100 includes the main pipe 10 and the auxiliary pipe 21 whose lengths cannot be changed; but this is not a restriction. It is possible to modify the main pipe 10 and the auxiliary pipe 21 with changeable lengths. For example, it is possible to use a slide pipe which can be partially operated to change its length. In this case, it is necessary to arrange a stopper for fixing the changed part of a slide pipe which is partially operated to change its length. That is, a player may partially operate a slide pipe to change its lengths, and then a player may fix the changed part of a slide pipe in position with a stopper. This makes it possible to change resonating property of a mute. A player is able to play music with various sounds by use of a mute which can be changed in resonating property and attached to a brass instrument.

(l) Twelfth Variation

In the foregoing embodiment, the mute 100 includes a plurality of pipes each of which has a circular sectional shape; but this is not a restriction. It is possible to employ pipes with elliptical sectional shapes, polygonal sectional shapes, or the like. Alternatively, it is possible to employ pipes whose sectional shapes may be differentiated in the axial direction. For example, it is possible to employ pipes with internal spaces whose sectional shapes may be continuously changed or discontinuously changed.

(m) Thirteenth Variation

The mutes according to the foregoing embodiment and variations are each configured of a plurality of pipes whose axial directions are perpendicular to each or parallel to each other; but this is not a restriction. It is possible to design mutes each including a plurality of pipes whose axial directions cross each other with an arbitrary angle except for 0 degrees (i.e. parallel) and 90 degrees (i.e. perpendicular). Alternatively, it is possible to modify the mute 100 such that the axial direction of the auxiliary pipe 21 is slanted to the axial direction of the main pipe 10.

Next, the resonating property of a brass instrument with/without a mute according to the foregoing embodiment and its variations will be discussed below.

Figure 21:
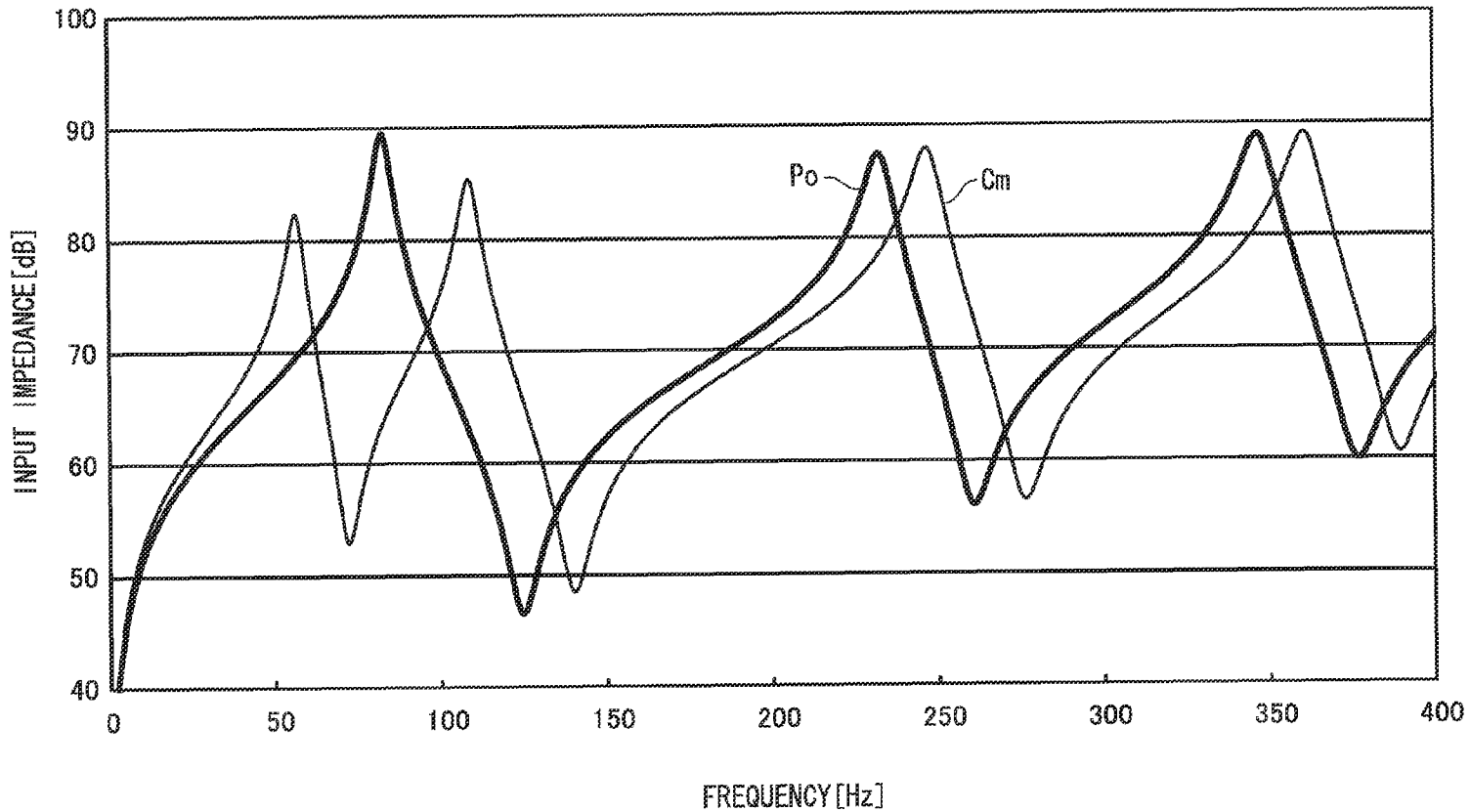
FIG. 21 is a graph showing resonating property of a brass instrument with/without a conventional mate.

FIG. 21 is a graph showing resonating property of a brass instrument with/without a conventional mute, wherein $P_0$ denotes a characteristic curve representing resonating peaks of a brass instrument without a mute, while Cm denotes a characteristic curve representing resonating peaks of a brass instrument with a conventional mute. This graph clearly shows that the conventional mute inevitably undergoes unwanted resonating peaks in the low register.

Figure 22:
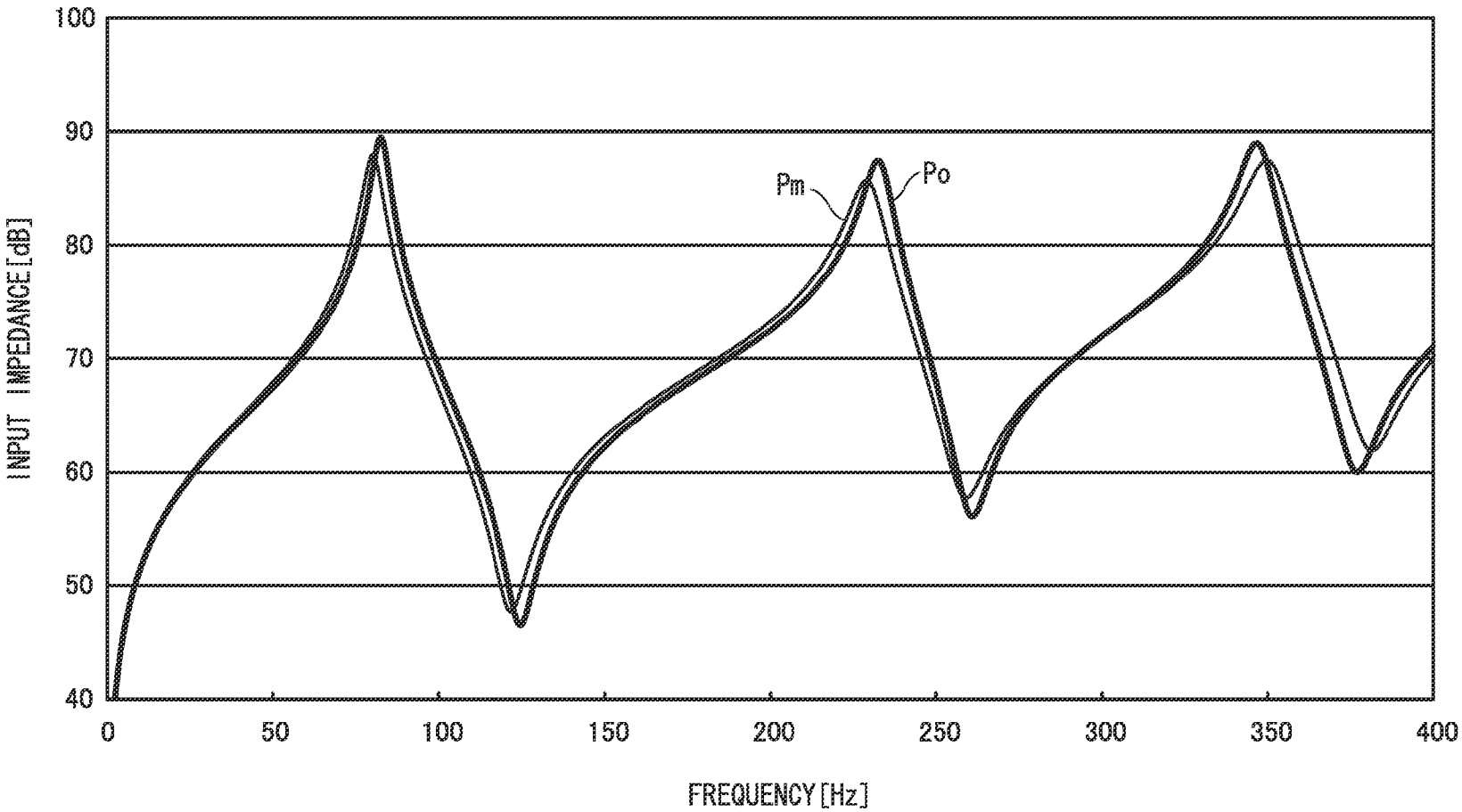
FIG. 22 is a graph showing resonating property of a brass instrument with/without a mute having two branch pipes.

FIG. 22 is a graph showing resonating property of a brass instrument with/without a mute having two branch pipes (e.g. the mute 100*g* shown in FIG. 11), wherein $P_0$ denotes a characteristic curve representing resonating peaks of a brass instrument without a mute, while Pm denotes a characteristic curve representing resonating peaks of a brass instrument with the mute 100*g*. Compared to FIG. 21 showing that the conventional mute inevitably undergoes resonating peaks in the low register, FIG. 22 clearly shows that at the mute 100*g* does not cause unwanted resonating peaks in the low register. Thus, it is possible to improve pitches and tone colors at low-degree peaks.

In this connection, a mute with a single branch pipe does not cause unwanted resonating peaks in the low register, whilst the mute 100*g* having two branch pipes is able to further improve pitches and tone colors. Additionally, FIG. 22 shows that two characteristic curves Pm, $P_0$ (relating to a brass instrument with/without the mute 100*g*) exhibit their resonating properties with small deviations of pitches therebetween. This indicates that the mute 100*g* is able to reproduce pitches in a more accurate manner than the conventional mute.

Lastly, the present invention is described in conjunction with the foregoing embodiment and variations, which can be further modified in various ways within the scope of the invention as defined in the appended claims.

What is claimed is:

1. A mute for a bass instrument with a bell pipe, the mute comprising:
- a main pipe; and
- at least one auxiliary pipe,
- wherein an internal space of the main pipe is connected to an internal space of the auxiliary pipe at an interconnect part, and
- wherein an air flow blown into the bell pipe is introduced into the main pipe, and
- wherein the air flow introduced into the main pipe is branched to the auxiliary pipe and emitted from an opening end of the main pipe and an opening end of the auxiliary pipe.

2. A mute for a bass instrument with a bell pipe, the mute comprising:
- a main pipe; and
- at least one auxiliary pipe,
- wherein an internal space of the main pipe is connected to an internal space of the auxiliary pipe at an interconnect part, and
- wherein the auxiliary pipe is separated from the main pipe and partly covers an external circumference of the main pipe.

3. A mute for a bass instrument with a bell pipe, the mute comprising:
- a main pipe;
- at least one auxiliary pipe; and
- a fixed part,
- wherein an internal space of the main pipe is connected to an internal space of the auxiliary pipe at an interconnect part,
- wherein the fixed part is disposed externally of the main pipe and is attachable to a tapered portion of the bell pipe of the brass instrument, and
- wherein the fixed part includes at least one cavity that partly transmits an air flow blown into the bell pipe attached to the brass instrument.

4. The mute according to claim 1, further comprising a fixed part disposed externally of the main pipe and is attachable to a tapered portion of the bell pipe of the brass instrument.

5. The mute according to claim 1, wherein the auxiliary pipe is separated from the main pipe and partly covers an external circumference of the main pipe.

6. The mute according to claim 4, wherein the fixed part includes at least one cavity that partly transmits an air flow blown into the bell pipe attached to the brass instrument.

7. The mute according to claim 2, wherein:
- the fixed part is disposed externally of the main pipe and is attachable to a tapered portion of the bell pipe of the brass instrument, and
- the fixed part includes at least one cavity that partly transmits an air flow blown into the bell pipe attached to the brass instrument.

* * * * *